US009542812B2

(12) United States Patent
Guinn et al.

(10) Patent No.: US 9,542,812 B2
(45) **Date of Patent: *Jan. 10, 2017**

(54) WAGERING GAME LEADERBOARDS

(71) Applicant: Bally Gaming, Inc., Las Vegas, NV (US)

(72) Inventors: Andrew C. Guinn, Chicago, IL (US); Damon E. Gura, Chicago, IL (US); Michael W. Mastropietro, Chicago, IL (US); Richard B. Robbins, Glenview, IL (US); Richard T. Schwartz, Deerfield, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/841,462

(22) Filed: Aug. 31, 2015

(65) Prior Publication Data

US 2015/0371504 A1 Dec. 24, 2015

Related U.S. Application Data

(63) Continuation of application No. 13/752,980, filed on Jan. 29, 2013, now Pat. No. 9,123,201, which is a continuation of application No. 13/388,632, filed as application No. PCT/US2010/054265 on Oct. 27, 2010, now Pat. No. 8,376,825.

(60) Provisional application No. 61/255,675, filed on Oct. 28, 2009.

(51) Int. Cl.
*G07F 17/32* (2006.01)

(52) U.S. Cl.
CPC ..... *G07F 17/3276* (2013.01); *G07F 17/32* (2013.01); *G07F 17/3244* (2013.01)

(58) Field of Classification Search
CPC ..... G07F 17/32
See application file for complete search history.

(56) References Cited

U.S. PATENT DOCUMENTS

| | | | |
|---|---|---|---|
| 8,376,825 | B2 | 2/2013 | Guinn et al. |
| 2004/0166940 | A1 | 8/2004 | Rothschild |
| 2007/0077988 | A1 | 4/2007 | Friedman |
| 2009/0048012 | A1 | 2/2009 | Patel et al. |
| 2012/0136465 | A1 | 5/2012 | Guinn et al. |

(Continued)

FOREIGN PATENT DOCUMENTS

| | | |
|---|---|---|
| WO | 2006099382 | 9/2006 |
| WO | 2007006002 | 1/2007 |
| WO | 2011053639 | 5/2011 |

OTHER PUBLICATIONS

"PCT Application No. PCT/US10/54265 International Preliminary Report on Patentability", Oct. 12, 2011, 30 pages.

(Continued)

*Primary Examiner* — Omkar Deodhar
(74) *Attorney, Agent, or Firm* — DeLizio Law, PLLC

(57) ABSTRACT

Leaderboards that aggregate data from across different wagering games (e.g., online wagering games and casino based wagering games) can create a game independent spirit of competition and recognition. Wagering game data of a plurality of players across different wagering games can be aggregated together. The plurality of players are ranked based, at least in part, on the wagering game data aggregated across the different wagering games. A leaderboard is updated based, at least in part, on the ranking of the plurality of players.

20 Claims, 10 Drawing Sheets

(56) References Cited

U.S. PATENT DOCUMENTS

2013/0144412 A1 6/2013 Guinn et al.

OTHER PUBLICATIONS

"PCT Application No. PCT/US10/54265 International Search Report", Dec. 27, 2010, 10 pages.
"U.S. Appl. No. 13/388,632 Office Action", May 1, 2012, 7 pages.
"U.S. Appl. No. 13/752,980 Final Office Action", Jan. 8, 2015, 9 Pages.
"U.S. Appl. No. 13/752,980 Office Action", Jun. 2, 2014, 9 Pages.
"U.S. Appl. No. 13/752,980 Office Action", Sep. 15, 2014, 6 Pages.
Co-pending U.S. Appl. No. 13/752,980, filed Jan. 29, 2013, 58 pages.

WAGERING GAME LEADERBOARDS

RELATED APPLICATIONS

This application claims priority to, and is a continuation application of, U.S. application Ser. No. 13/752,980, filed on Jan. 29, 2013, which is itself a continuation of U.S. application Ser. No. 13/388,632, filed on Feb. 2, 2012. The Ser. No. 13/388,632 application is a 371 of PCT/US10/54265, filed on Oct. 27, 2010, which claims the priority benefit of U.S. Provisional Application No. 61/255,675 filed Oct. 28, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

FIELD

Embodiments of the inventive subject matter relate generally to wagering game systems, and more particularly to wagering game leaderboards.

BACKGROUND

Leaderboards are used as scoreboards for players to keep track of their scores or winnings in a wagering game. A leaderboard can encourage a spirit of competition among players by comparing and ranking a top set of players based on scores—starting with a highest scoring player to a lowest scoring player. Additionally, the leaderboard is updated at regular intervals to reflect a latest top set of players and player scores.

BRIEF DESCRIPTION OF THE FIGURES

Embodiments of the invention are illustrated in the Figures of the accompanying drawings in which.

DESCRIPTION OF THE EMBODIMENTS

The description that follows includes exemplary systems, methods, techniques, instruction sequences, and computer program products that embody techniques of the present inventive subject matter. However, it is understood that the described embodiments may be practiced without these specific details. For instance, although examples create leaderboards for indicating top ranking players in wagering games, leaderboards can also be created to reflect player statistics and game play behavior (e.g., a set of players who have played the most number of wagering games, a set of players who have wagered the most money, etc). In other instances, well-known instruction instances, protocols, structures, and techniques have not been shown in detail in order not to obfuscate the description.

Sponsors (e.g., third party companies, casinos, etc.) typically determine a location for placing advertisements to promote their products and brand based on an expected number of advertisement viewings. In a wagering game environment, a leaderboard for a wagering game ("wagering game leaderboard") can serve as an effective marketing tool for the sponsor's products and brand. As an example, in placing product symbols as advertisements in a slots wagering game, only a select number of spins (e.g., 1 in 200 spins) may reveal the product symbols. As another example, a product advertisement may be presented for a short time interval soon after the wagering game ends. In contrast, advertisements on the wagering game leaderboard are viewed more frequently, thus constantly reinforcing the sponsor's brand. Leaderboard-based marketing can help foster brand relationship by tying the online wagering game to the sponsor by allowing the sponsor to customize wagering game leaderboards and/or present marketing offers. The marketing offers can enable the sponsor to market its brand to players and can also enable the casino to entice the players to play the wagering games in order to win the marketing offers. Additionally, a variety of leaderboards catering to different game play behaviors, achievement levels, wagering games, non-gaming activity, and aggregate scores can help appeal to a competitive side in the players, challenge, and motivate the players to play a wide variety of online and casino-based wagering games.

Figure 1:
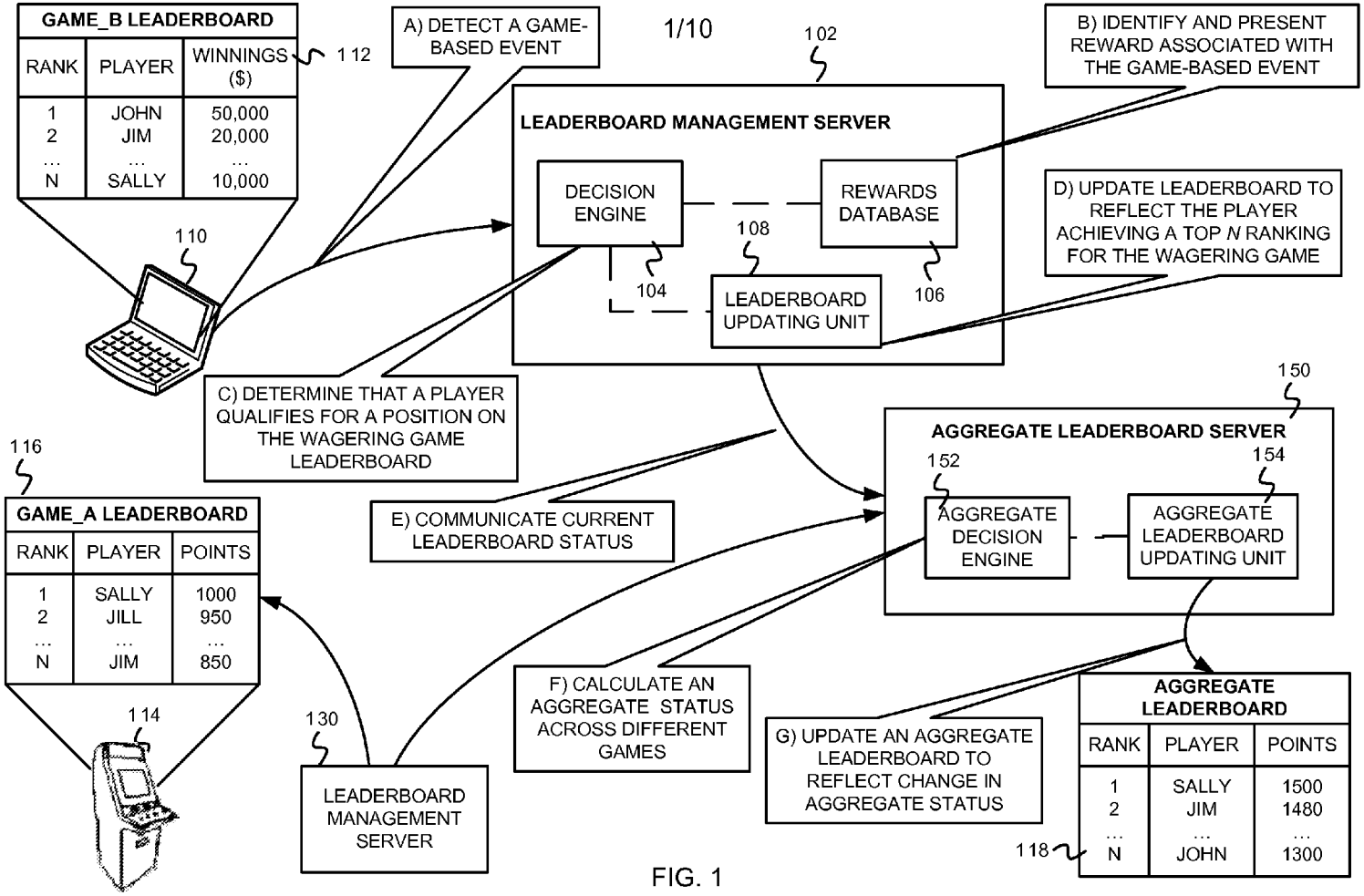
FIG. 1 is a conceptual diagram illustrating managing wagering game leaderboards.

FIG. 1 is a conceptual diagram illustrating managing wagering game leaderboards. FIG. 1 depicts two leaderboard management servers—leaderboard management server 102 and leaderboard management server 130. The leaderboard management server 102 creates leaderboard 112 for wagering game B being played on computer system 110. The leaderboard management server 102 controls content of and presents the wagering game leaderboard 112 on the computer system 110. The leaderboard management server 102 can also manage rewards and determine whether or not players qualify for a position on the wagering game leaderboard 112. The leaderboard management server 102 comprises a decision engine 104, a leaderboard updating unit 108, and a rewards database 106. The decision engine 104 is coupled with the leaderboard updating unit 108, and the rewards database 106. Likewise, the leaderboard management server 130 creates wagering game leaderboard 116 for wagering game A being played on wagering game machine 114. The leaderboard management server 130 controls content of and presents the wagering game leaderboard 116 on the wagering game machine 114. The leaderboard management server 130 can also control rewards and criteria associated with players achieving leaderboard status on the wagering game leaderboard 116. Although not depicted in FIG. 1, the leaderboard management server 130 may comprise a distinct decision engine, a rewards database, and a leaderboard updating unit.

The leaderboard management servers 102 and 130 also communicate with an aggregate leaderboard server 150. The aggregate leaderboard server 150 controls content of an aggregate leaderboard 118 based on the content of the wagering game leaderboards 112 and 116. The aggregate leaderboard server 150 comprises an aggregate decision engine 152 and an aggregate leaderboard updating unit 154. The aggregate leaderboard 118 presents an aggregation of the wagering game leaderboards 112 and 116 and present an indication of overall standings (or ranking) of the wagering game players.

At stage A, the leaderboard management server 102 detects a game-based event. A wagering game server (not shown) may generate the game-based event in response to a player at the computer system 112 satisfying pre-defined criteria associated with the wagering game B. For example, the wagering game server may generate a game-based event in response to the player wagering, winning, or losing an amount of money. As another example, the wagering game server may generate the game-based event upon determining that the player has collected a pre-defined number of symbols. As another example, the wagering game server may generate the game-based event in response to the player successfully completing N levels of the wagering game. The wagering game server can communicate the game-based event to the leaderboard management server 102. In addition to detecting the game-based event, the leaderboard management server 102 may also keep track of player selections in the wagering game, consequences of the selections, frequency of wagering game play, etc. to identify trends in the player's behavior. Embodiments can correlate the wagering game events/outcomes with the player's behavior. For example, statistical gaming data (e.g., frequency of wagering game play, wagered amount, win to loss ratio, etc.) associated with the players may be analyzed to determine the trends in the players' behavior. In some implementations, the leaderboard management server 102 may modify the criteria associated with the wagering game leaderboard based on the trends.

At stage B, the decision engine 104 identifies and presents rewards associated with the game-based event. The decision engine 104 accesses the rewards database 106, and determines whether the player qualifies for a reward based on the game-based event and/or the player's game play behavior. For example, the decision engine 104 may access the rewards database 106 and determine that by spending $100 the player wins 20 rounds of free game play for an online slot wagering game. The decision engine 104 may direct the wagering game server to present the reward to the player on the computer system 110. The decision engine 104 may also update a player account server (not shown) to indicate the reward presented to the player.

The rewards database 106 can comprise a set of rules indicating rewards corresponding to the game-based events. In some implementations, a sponsor sponsoring the wagering game may indicate criteria for the game-based event and criteria for receiving the reward. The sponsor may also sponsor the reward. For example, the player may earn X number of airline miles if the player plays a wagering game sponsored by the airline for five consecutive days. As another example, a wagering game design company sponsoring the wagering game leaderboard may offer a tour of the wagering game design company if the player plays the latest wagering games designed by the company for five consecutive days. The wagering game server may keep track of the player's game play behavior by recording when the players logs in, the online wagering games played, etc. The wagering game server may generate a game-based event if the player plays the specified wagering games for five consecutive days.

At stage C, the decision engine 104 determines that the player qualifies for a position on the wagering game leaderboard 112. The decision engine 104 may determine whether or not the player qualifies for a position on the wagering game leaderboard 112 based on the game-based event and/or the player's game play behavior. The decision engine 104 can also determine whether or not the player qualifies for a position on the wagering game leaderboard 112 based on a number of reward credits (e.g., game points based on individual game leaderboards, loyalty club points, etc.), monetary value of wins, number of rewards received, etc. The decision engine 104 may consult a set of rules associated with the wagering game leaderboard 112 to determine whether the player qualifies for a position on the wagering game leaderboard 112. For example, the rules may dictate that the player qualifies for a position on the wagering game leaderboard 112 if the player accumulates more than a thousand game points. In some implementations, sponsors sponsoring the wagering game leaderboard 112 may set requirements that the player should satisfy in order to qualify for a position on the wagering game leaderboard 112. For example, a car manufacturer sponsor may require the player to locate and collect (while playing the wagering games) at least a hundred car symbols to be a contender for a position on the wagering game leaderboard 112. As another example, the car manufacturer sponsor may give bonus points to or have lower/easier criteria for a player who owns one of their automobiles.

The sponsor may also determine the metric of the leaderboard. For example, the sponsor may indicate that the reward credits should be presented in terms of game points (e.g., awarding X game points for achieving a specified game-based event). As an example, a beverage sponsor may indicate that reward credits should be presented in terms of beverage symbols (e.g., awarding X beverage symbols for achieving the specified game-based event). In some implementations, components of the wagering game may be relabeled based on the sponsor's product. For example, a slot wagering game sponsored by a beverage company may be relabeled to present pictures of beverages as symbols on the slot machine's reels.

In some implementations, the rewards received from achieving the game-based event may also be considered while determining the player's position on the wagering game leaderboard 112. For example, Jim may win $15000 playing the wagering game B. Jim may also receive a reward (e.g., free game play, a one-year subscription to the casino's magazine, etc.). The decision engine 104 may determine (e.g., based on the rules) that the monetary value of Jim's reward is $5000, bringing Jim's total winnings to $20000. The decision engine 104 may then compare Jim's winnings with winnings of other players currently on the wagering game leaderboard 112 and determine that Jim should be in the second position on the wagering game leaderboard 112. The decision engine 104 can direct the leaderboard updating unit 108 to change content of the wagering game leaderboard 112.

At stage D, the leaderboard updating unit 108 updates the wagering game leaderboard 112 to reflect the player achieving a top N ranking for the wagering game B. As indicated in the wagering game leaderboard 112, the leaderboard management server 102 ranks players based on an amount of money won while playing the wagering game B. In FIG. 1, the leaderboard updating unit 108 updates the wagering game leaderboard 112 by placing Jim in second position and decreasing rank of subsequent players on the wagering game leaderboard 112 accordingly.

The wagering game leaderboard 112 may be presented on a webpage of the online wagering game. In some implementations, the wagering game leaderboard 112 may be presented to anyone who accesses the online wagering game webpage. In other implementations, the wagering game leaderboard 112 may be presented only after the player logs into the casino's website. The player account server may detect the player's login information, identify one or more wagering game leaderboards on which the player is ranked, and present the wagering game leaderboards. An indication of a number of reward credits required for advancing to a next level, winning a reward, achieving a higher position on the wagering game leaderboards, etc. can also be presented.

At stage E, the leaderboard management server 102 communicates a current leaderboard status to the aggregate leaderboard server 150. In one implementation, the decision engine 104 may communicate the current leaderboard status to the aggregate decision engine 154. In another implementation, the aggregate decision engine 152 may receive a notification in response to the leaderboard updating unit 108 updating the wagering game leaderboard 112. The aggregate leaderboard server 150 may also monitor content of the wagering game leaderboard 112, operations of the decision engine 104 and/or operations of the leaderboard updating unit 108 to detect a change in the current leaderboard status. In one implementation, the leaderboard management server 102 communicates changes from a previous leaderboard status. In another implementation, the leaderboard management server 102 may transmit the content of the wagering game leaderboard 112 to the aggregate leaderboard server 150. The aggregate leaderboard server 150 may also receive a current leaderboard status of the wagering game leaderboard 116.

At stage F, the aggregate decision engine 152 calculates an aggregate status across different wagering games. In one implementation, data of different wagering games can be aggregated for each player playing the wagering games. With reference to FIG. 1, the aggregate decision engine 152 determines an aggregate score for each player playing the wagering games A and B based on the content of the wagering game leaderboards 112 and 116. The aggregate decision engine 152 may calculate the aggregate score based on monetary value of wagering game wins, reward credits associated with the wagering game wins, reward credits associated with rewards received as a result of satisfying game-based events, etc. In one implementation, the aggregate decision engine 152 may calculate the aggregate score by assigning game points based on the player's position on each of the wagering game leaderboards 112 and 116. For example, a player in first position on the wagering game leaderboard 112 may be awarded ten reward points, a player in second position on the wagering game leaderboard 112 may be awarded eight reward points, and so on. The aggregate decision engine 152 may determine the player's position on the aggregate leaderboard 118 based on a sum of the reward points. To aggregate the data of different wagering games, player information and gaming data associated with each of the players may also be determined (e.g., by accessing a player account server). Credits may be awarded to the players depending on the player's gaming data. The gaming data may describe the player's game play behavior (e.g., how often the player plays the wagering game, an average amount of money wagered, etc).

Also, as depicted in FIG. 1, a metric of the wagering game leaderboard 112 is a monetary value of the players' winnings, while a metric of the wagering game leaderboard 116 and the aggregate leaderboard 118 is game points. The aggregate decision engine 152 may convert reward credits from one leaderboard metric to another leaderboard metric or normalize the reward credits across the wagering game leaderboards 112 and 116 in order to rank the players based on a common metric. The aggregate decision engine 152 may convert the monetary value of the player's winnings on the wagering game leaderboard 112 into an equivalent number of game points in order to determine the player's position on the aggregate leaderboard 118. For example, the aggregate decision engine 152 may assign 1 game point for every $100 in winnings and accordingly determine that John on the wagering game leaderboard 112 has 500 game points. The aggregate decision engine 152 can add the game points for each of the players across each of the wagering game leaderboards 112 and 116 to determine the player's position on the aggregate leaderboard 118. Accordingly, the aggregate leaderboard updating unit 154 may update the aggregate leaderboard 118 to indicate the top N players across all the wagering games. Additionally, the aggregate decision engine 152 may also access a rewards database (not shown) to identify and present rewards to the players on the aggregate leaderboard 118. The rewards may also be converted into an equivalent number of game points that may be taken into consideration while updating the aggregate leaderboard 118.

At stage G, the aggregate leaderboard updating unit 154 updates the aggregate leaderboard 118 to reflect a change (if any) in aggregate leaderboard status and overall player rankings.

In addition to the aggregate leaderboard 118, the aggregate leaderboard server 150 may also maintain and present wagering game player statistics. The statistics may describe the player's current overall ranking (e.g., position on the aggregate leaderboard 118), ranking in each wagering game played (e.g., position on each of the wagering game leaderboards 112 and 116), ranking in contests or challenges in which the player participated, a number of reward credits required to earn a next reward or a higher position on the leaderboards 112 and 116, etc. For example, the statistics may indicate that the player is ranked 100 in the wagering game A, ranked 12 in the wagering game B, and is X points away from being a contender to win an all expense paid cruise.

Leaderboards can also help prolong a wagering game win or other such achievement. Instead of presenting a fleeting congratulatory screen, the wagering game win can be extended by highlighting the player's name on an appropriate leaderboard, allowing the player to save a copy of the leaderboard (e.g., screenshot saved to a player account), etc. The player may also have an option of publicizing his/her position on the wagering game leaderboard as described in FIG. 2.

Figure 2:
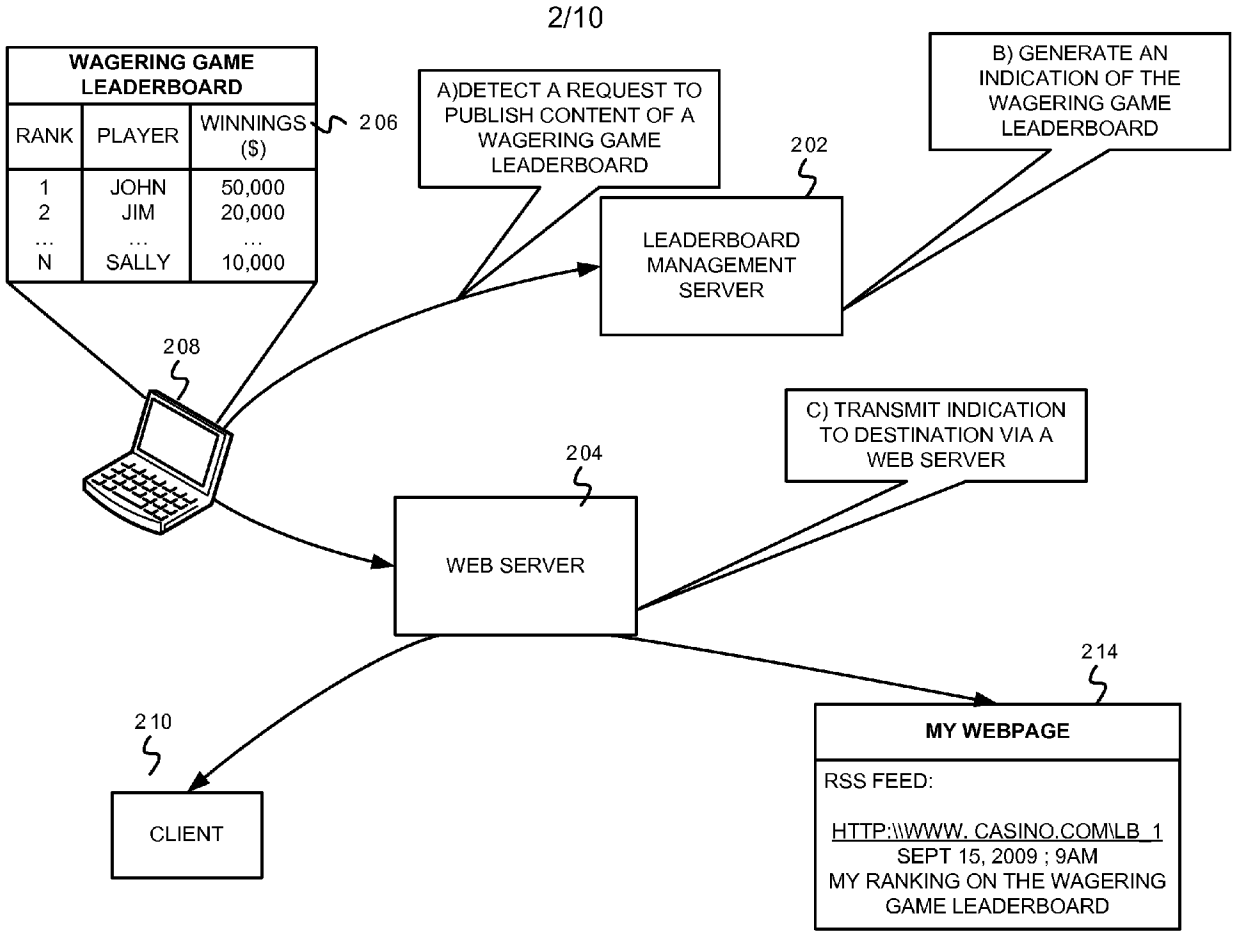
FIG. 2 is an example conceptual diagram illustrating operations for publishing content of a wagering game leaderboard.

FIG. 2 is an example conceptual diagram illustrating operations for publishing content of a wagering game leaderboard. FIG. 2 depicts a leaderboard management server 202. The leaderboard management server 202 creates leaderboard 206 for a wagering game currently being played on computer system 208. The computer system 208 and a client 210 communicate over a communication network via a web server 204. The web server 204 hosts websites 214.

At stage A, the leaderboard management server 202 detects a request for publishing the content of the wagering game leaderboard 206. In addition to the content of the wagering game leaderboard 206, a player may also publish content of an aggregate leaderboard, images of rewards and trophies, statistics indicating victories, etc. The request for publishing the content of the wagering game leaderboard 206 may be initiated by the computer system 208 (e.g., in response to a player clicking a "share my leaderboard" or "announce my victory" button). In some implementations, the request may comprise information identifying a destination to which the content of the wagering game leaderboard should be transmitted. For example, the request might include an email address associated with the client 210, a phone number of the client 210 for transmitting a short messaging service (SMS) message, a website address/Internet Protocol (IP) address of the website 214, etc. In another implementation, the request may not comprise the information identifying the destination and may be a request for a link to the content of the wagering game leaderboard 206.

At stage B, the leaderboard management server 202 generates an indication of the wagering game leaderboard 206. The leaderboard management server 202 may generate a Uniform Resource Locator (URL) to the location of the content of the wagering game leaderboard 206. In some implementations, the leaderboard management server 202 may also generate an RSS feed to provide periodic updates about the player's position on the wagering game leaderboard 206, number of credits and rewards accrued, etc.

At stage C, the indication of the wagering game leaderboard 206 is transmitted to the destination via the web server 204. In some implementations, the leaderboard management server 202 may first transmit the indication of the wagering game leaderboard 206 to the computer system 208. Following this, the computer system 208 may transmit the indication to the destination. For example, the player at the computer system 208 may send the URL to a friend at the client 210 in an email message, an SMS, an instant message, etc. As another example, the player at the computer system 208 may add the URL to or publish the RSS feed on his/her webpage 214, etc. As another example, the player at the computer system 208 may upload saved content or screenshots of the wagering game leaderboard 206 to the webpage 214. In other implementations, if the request comprises the information identifying the destination, the leaderboard management server 202 may transmit the indication to the destination. For example, the leaderboard management server 202 may transmit an email message comprising the URL to the client 210. As another example, the leaderboard management server 202 may transmit the content of the wagering game leaderboard in an email message, an SMS, an instant message, etc. to the destination. As another example, the leaderboard management server 202 may place a phone call to a phone number associated with the destination (e.g., a user's mobile phone) and play a pre-recorded message or a user-customized message.

In some implementations, a history of the wagering game leaderboard 206 may be maintained for a certain interval of time. For example, the leaderboard management server 202 may store content of the wagering game leaderboard for a year. The player may have an option of accessing, viewing, and sharing past content of the wagering game leaderboard 206.

Figure 3:
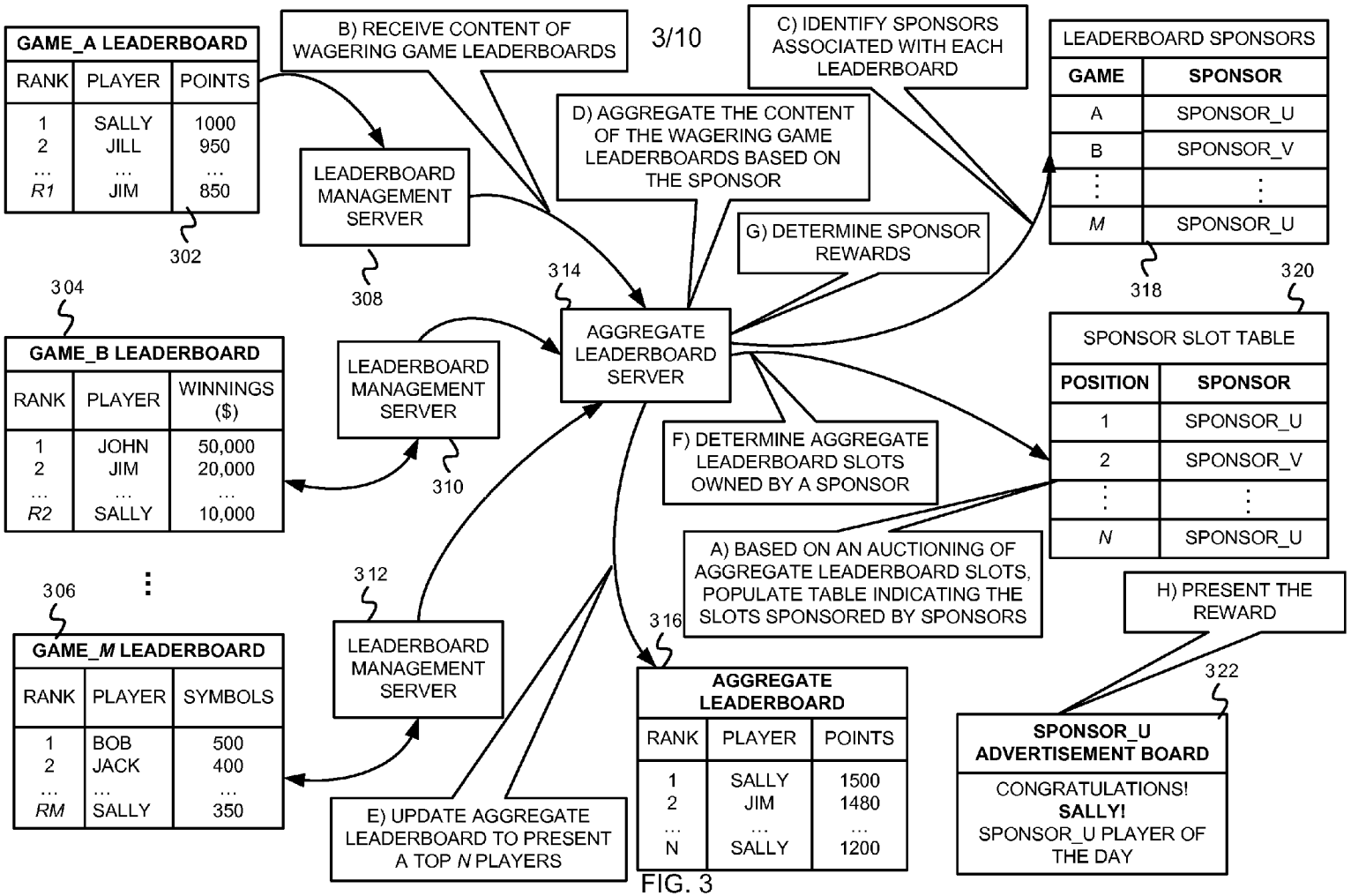
FIG. 3 is a conceptual diagram illustrating provision and use of slots on a multi-sponsor aggregate leaderboard.

FIG. 3 is a conceptual diagram illustrating provision and use of slots on a multi-sponsor aggregate leaderboard. FIG. 3 depicts M wagering game leaderboards, each of which is controlled by a separate leaderboard management server. Leaderboard management server 308 creates and controls content of Game_A leaderboard 302. Leaderboard management server 310 creates and controls content of Game_B leaderboard 304. Likewise, leaderboard management server 312 creates and controls content of Game_M leaderboard 312. Also, each of the wagering game leaderboards 302, 304, and 306 can present any suitable number of players on the wagering game leaderboards. As indicated in FIG. 3, the wagering game leaderboard 302 displays a top R1 players, the wagering game leaderboard 304 displays a top R2 players, and the wagering game leaderboard 306 displays a top R3 players. Each of the leaderboard management servers 308, 310, and 312 communicate with an aggregate leaderboard server 314.

The aggregate leaderboard server 314 creates and controls content of an aggregate leaderboard 316 based on the content of the wagering game leaderboards 302, 304, and 306. Additionally, the aggregate leaderboard server 314 accesses leaderboard sponsors table 318.

The leaderboard sponsors table 318 indicates sponsors who have sponsored the wagering game leaderboards 302, 304, and 306. A sponsor may sponsor any number of wagering game leaderboards. As described above, by sponsoring the wagering game leaderboard, the sponsor can control reward criteria, criteria for achieving game-based events, content of the wagering game and/or the wagering game leaderboard, etc. As depicted in FIG. 3, sponsor_U sponsors the Game_A leaderboard 302 and the game_M leaderboard 306. Sponsor_V sponsors the Game_B leaderboard 304. The aggregate leaderboard server 314 also accesses a sponsor-slot table 320 to determine slots (or positions) on the aggregate leaderboard 316 that have been sponsored by a sponsor. As indicated in the sponsor slot table 320, sponsor_U sponsors positions 1 and N on the aggregate leaderboard 316, and sponsor_V sponsors position 2 on the aggregate leaderboard 316.

Based on a player's position on the aggregate leaderboard 316 and the sponsor who sponsored the position on the aggregate leaderboard 316, the player may receive sponsor rewards, recognition (e.g., placement on the sponsor's advertisement board 322), etc.

At stage A, based on an auctioning of aggregate leaderboard slots, the sponsor slot table 320 is populated to indicate aggregate leaderboard slots sponsored by the sponsors. For example, a slot-auctioning unit (not shown) may perform functions for auctioning the aggregate leaderboard slots. Sponsors may bid for the aggregate leaderboard slots via the Internet or other communication network. A time for which bidding for the aggregate leaderboard slots may be permitted may be variable and may be determined based on a number of sponsors and available slots, value of the bids, etc. The sponsors may place bids via a web-page, a mobile phone, or any suitable electronic device. The slot-auctioning unit may receive the sponsors' bids and update a current bid value of the aggregate leaderboard slots. A name of the sponsor with the highest bid may or may not be indicated. The bidding process can continue until an allotted bidding time elapses. The bidding process may be terminated if no bids are received for a pre-defined amount of time. The auctioning of the aggregate leaderboard slots may be performed at pre-determined intervals of time. For example, the aggregate leaderboard slots may be auctioned every two days, every week, etc. After the auctioning of the aggregate leaderboard slots is completed, the sponsor slot table 320 is populated to indicate auctioning results and aggregate leaderboard slots won by the sponsors. As depicted in the sponsor-slot table 320, the sponsor_U bid on and won slots 1 and N of the aggregate leaderboard 316. Likewise, the sponsor_V bid on and won slot 2 of the aggregate leaderboard 316. Although the illustration uses an auction mechanism, embodiments are not so limited. Embodiments can provision slots based on game popularity, contracts with sponsors, fixed fees, etc.

At stage B, the aggregate leaderboard server 314 receives content of the wagering game leaderboards 302, 304, and 306 from respective leaderboard management servers 308, 310, and 312. The leaderboard management servers 308, 310, and 312 may communicate a rank of players, player identification information (e.g., player name, player gaming identifiers, etc.), a number of reward credits (e.g., game points, money, symbols, etc.) accrued on the respective wagering game leaderboards 302, 304, and 306. Alternately, the aggregate leaderboard server 314 may access and read the content of the wagering game leaderboards 302, 304, and 306.

At stage C, the aggregate leaderboard server 314 accesses the leaderboard sponsors table 318 to identify sponsors associated with each of the wagering game leaderboards 302, 304, and 306. The aggregate leaderboard server 314 may determine that sponsor_U sponsors the Game_A leaderboard 302 and the game_M leaderboard 306, sponsor_V sponsors the Game_B leaderboard 304, etc.

At stage D, the aggregate leaderboard server 314 aggregates the content of the wagering game leaderboards based on the sponsor that sponsored each of the wagering game leaderboards. For instance, because the sponsor_U sponsors the wagering game leaderboards 302 and 306, the aggregate leaderboard server 314 aggregates the content of the wagering game leaderboards 302 and 306. As described earlier, in some implementations, the aggregate leaderboard server 314 may calculate an aggregate score by assigning game credits based on the player's position on the wagering game leaderboards 302 and 306. In other implementations, the aggregate leaderboard server 314 may determine the aggregate score based on a sum of the reward credits. The aggregate leaderboard server 314 may also convert reward credits from one leaderboard metric (e.g., symbols for the wagering game leaderboard 306) to another leaderboard metric (e.g., game points for the wagering game leaderboard 302) or normalize the reward credits. For example, if one symbol is equivalent to one point, Sally's aggregate score calculated over the wagering game leaderboards 302 and 306 sponsored by sponsor_U may be 1350 points (i.e., a sum of 1000 points from the wagering game leaderboard 302 and 350 points from the wagering game leaderboard 306).

At stage E, the aggregate leaderboard server 314 updates the aggregate leaderboard 316 to present top N players. The aggregate leaderboard server 314 can rank the players in decreasing order of their aggregate score (determined at stage D). Because aggregate scores are determined by aggregating content of the wagering game leaderboards on a sponsor-by-sponsor basis, a player may be placed at multiple positions on the aggregate leaderboard 316. As depicted on the aggregate leaderboard 316, Sally may receive an aggregate score of 1500 points based on an aggregation of content of wagering game leaderboards sponsored by the sponsor_U. Sally may also receive an aggregate score of 1200 points based on an aggregation of content of wagering game leaderboards sponsored by the sponsor_V. In presenting the top N players, the aggregate leaderboard server 314 may place Sally at position 1 and at position Non the aggregate leaderboard 316.

At stage F, the aggregate leaderboard server 314 determines aggregate leaderboard slots won by each of the sponsors. In FIG. 3, the aggregate leaderboard server 314 accesses the sponsor slot table 320 and determines that the sponsor_U has won (e.g., in the auctioning of the aggregate leaderboard slots) slots 1 and N on the aggregate leaderboard 316.

At stage G, the aggregate leaderboard server 314 determines sponsor rewards. For example, the aggregate leaderboard server 314 may access a rewards database and determine that Sally in a first position on the aggregate leaderboard 314 is a sponsor_U player of the week and that Sally's name will be displayed on the sponsor_U advertisement board 322. The sponsor rewards associated with specified positions on the aggregate leaderboard may be stored in a separate database independent of the rewards described with reference to FIG. 1. The sponsors may update the rewards awarded to players in the aggregate leaderboard slots depending on a number of slots sponsored by the sponsor, a ranking of the slots on the aggregate leaderboard, etc.

At stage H, the aggregate leaderboard server 314 presents the reward. The reward may be a monetary reward, a reward for additional game credits, position on an advertisement board, etc. In FIG. 3, the aggregate leaderboard server 314 can direct a controlling unit of the sponsor_U advertisement board 322 to display Sally's name on the sponsor_U advertisement board 322. In other implementations, each sponsor may control a reward unit independent of the aggregate leaderboard server 314. The aggregate leaderboard server 314 may communicate a name of the player(s) in the aggregate leaderboard slots won by the sponsor. For example, the aggregate leaderboard server 314 may transmit a message to sponsor_U's reward unit indicating that Sally is in first position on the aggregate leaderboard 316. The aggregate leaderboard server 314 may transmit a message to sponsor_V's reward unit indicating that Jim is in second position on the aggregate leaderboard 316, etc. The sponsors' reward units may accordingly present rewards to the appropriate players.

In addition, a display device that operates as the aggregate leaderboard 316 can also operate as an advertisement board. The aggregate leaderboard server or a different controlling device can control advertisements displayed on the display device in accordance with the slots purchased by sponsors. For example, Sponsor_U can be allocated the most amount of advertisement time and/or space on the display device because Sponsor_U purchased the top slot/position. Embodiments can also allocate different types of advertising in accordance with the sponsored position. For example, a sponsor of the top position can be allocated advertising space around the top position and across the top of the display device. The sponsor of the second position is limited to space adjacent to the second position. Sponsors of positions below a threshold position are grouped into a bottom portion of the display device for small periods of time. The particular configurations can be set at the aggregate leaderboard server or another controlling device.

Example Operations

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 4:
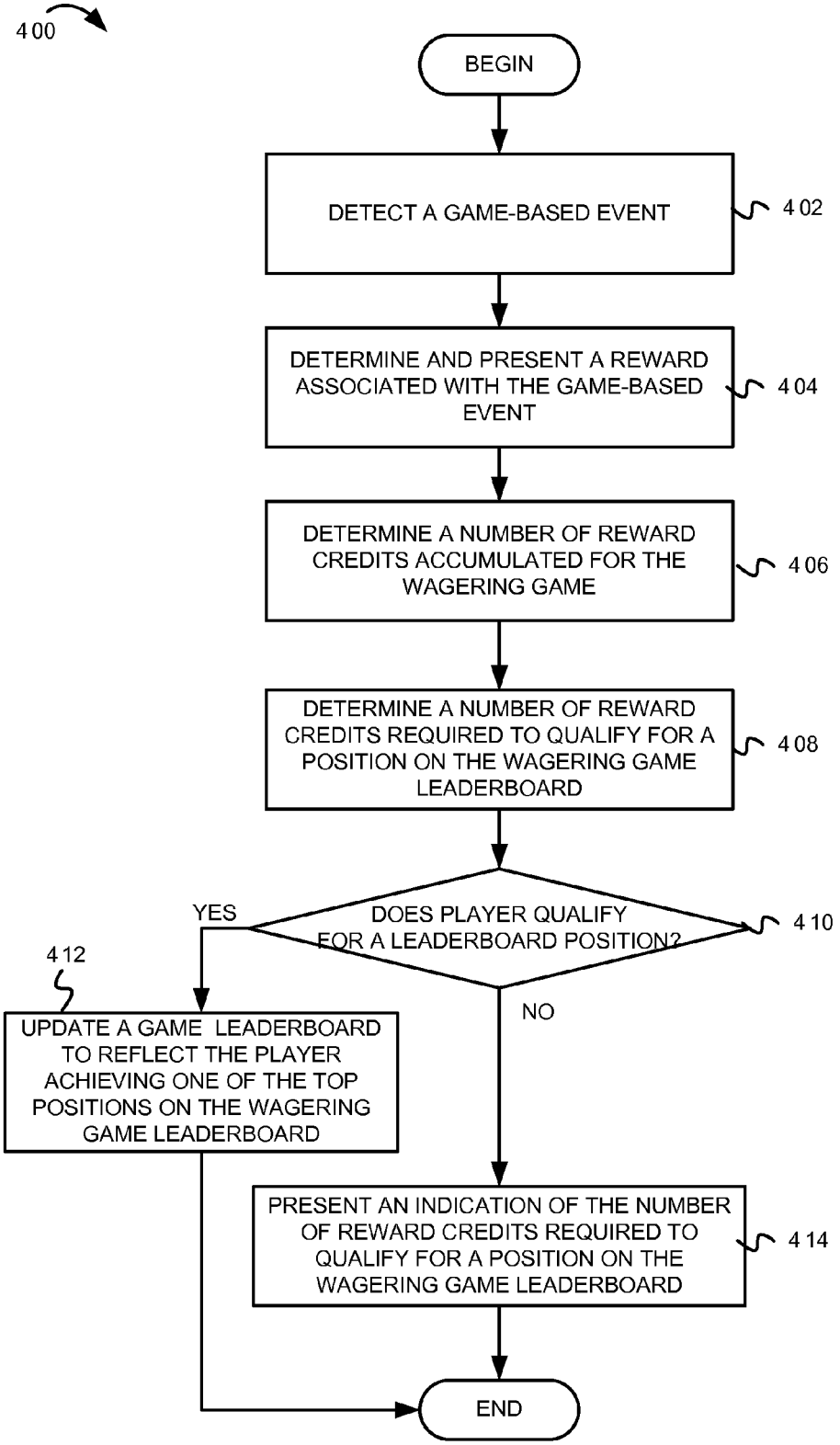
FIG. 4 is a flow diagram illustrating example operations for updating a wagering game leaderboard.

FIG. 4 is a flow diagram illustrating example operations for updating a wagering game leaderboard. Flow 400 begins at block 402.

At block 402, a game-based event is detected. The game-based event may be an event encountered as a result of a player achieving specified criteria associated with an online wagering game or a casino-based wagering game (e.g., a wagering game played on a wagering game machine in the casino). The flow continues at block 404.

At block 404, a reward associated with the game-based event is determined and presented. For example, a decision engine (e.g., the decision engine 104 of FIG. 1) may consult a rewards database 106 to determine the reward. The decision engine 104 may direct a wagering game server (or other web server) to present the reward on the player's computer system. As another example, the reward may be stored as part of the player account server and the player may view or access the reward at a later point in time (e.g., by clicking on a "view my rewards" tab).

In addition to the game-based event, the player's current position on a wagering game leaderboard, and/or the player's game play behavior may also be used to determine the reward. Examples of game play behavior include, how often and for how long the player plays the particular wagering game, how well the player plays the wagering games, how often the player achieves the game-based events, a number times the player satisfies criteria for receiving rewards, a number of wins and losses, etc. For example, the player may receive one reward for obtaining a certain combination of symbols in an online slot wagering game and another reward for having played the online slot wagering game everyday for a month. As another example, the player may receive one game point for every 5 consecutive spins, 5 game points for every $100 wagered, etc.

As indicated earlier, the rewards can comprise sponsor-based rewards. The sponsor-based rewards can comprise marketing offers offered by a wagering game sponsor or a wagering game leaderboard sponsor, free or discounted sponsor products, etc. For example, a beverage company sponsor may reward the player that locates a hundred beverage symbols within a week, while playing the wagering games, with a free case of beverages. The rewards can also comprise casino-based loyalty rewards to reward the players' loyalty to the casino. Examples of casino-based loyalty rewards can include coupons redeemable for free game play, meals at the casino's restaurant, an upgrade at the casino's hotel, and other such rewards centered around the casino's activities and services. For example, the player may receive a gift certificate for a free stay at the casino's hotel if the player plays the same wagering game online and on a physical wagering game machine in the casino.

Rewards may also be presented in response to players satisfying various challenges. In one implementation, the casino may define various achievement levels depending on e.g., an amount won, a number of wagering games played, etc. For example, the casino may define three achievement levels—big win, super win, and mega win—each of which are associated with the player winning a specified number of reward credits in a single game session. The players that satisfy the challenge e.g., achieving three big wins, two super wins, and two mega wins may receive a reward. The players may also be rewarded for changing game-play behavior. For example, the player who increases his/her wagers five-fold may receive N rounds of free game play. As another example, the wagering game player who loses thirty consecutive slot rounds in an online slot wagering game and wins a thirty-first slot round may be rewarded for his/her persistence with M free rounds of game play.

In some implementations, promotional offers and rewards may be awarded based on the player's game play behavior. For example, the player may receive a reward in response to the player logging in to the casino's online wagering game website for five consecutive days. As another example, the player may receive a marketing offer from a car manufacturer sponsor if the player wins at least 90% of the wagering games played.

It should be noted that the rewards might not be monetary rewards or redeemable rewards. In some implementations, the rewards may comprise customization options and online indications of achievement. For example, the player may be permitted to customize an avatar (e.g., add accessories to the avatar, add a background for the avatar, etc.) after the player plays a wagering game for a specified number of days. As another example, the casino may offer an online trophy, add a symbol of victory (e.g., a star, a crown, etc.) next to the player's name, place the player's photograph or avatar on the homepage of the casino's website or a webpage for the online wagering game, etc. After the reward is presented on the player's computer system (or other suitable electronic device such as a mobile phone, wagering game machine, a leaderboard display, etc.), the flow continues at block 406.

At block 406, a number of reward credits accumulated by the player for the wagering game is determined. The reward credits may comprise game points, money, symbols, etc. The player may receive reward credits for achieving game-based events, participating in wagering game tournaments, earning rewards, etc. For example, the player playing an online poker game may receive a different number of reward credits for different winning hands. In other words, the player may receive 10 game points for a pair of cards, 200 game points for a "full house", 500 game points for a "straight flush", etc. Additionally, the player may also receive reward credits for winning rewards associated with game-based events. For example, the player may win a coupon for a free dinner for two in response to getting a "royal flush". Thus, in addition to the 200 game points associated with getting a royal flush, the player may also receive e.g., 50 game points associated with the dinner coupon reward. In some implementations, a monetary value associated with the rewards might be determined. Referring to the above example, the player may win $500 after getting a "royal flush" in the online poker game. It may be determined that a monetary value associated with the dinner coupon reward is $50, thus bringing the player's total winnings for the online poker game to $550. The flow continues at block 408.

At block 408, a number of reward credits required to qualify for a position on the wagering game leaderboard is determined. A set of rules associated with the wagering game leaderboard may be consulted to determine the number of reward credits required to achieve leaderboard status. For example, the rules may indicate that the player qualifies for a position on the wagering game leaderboard if the player accumulates more than a thousand game points. In some implementations, a wagering game leaderboard sponsor may customize the wagering game leaderboard and specify requirements for qualifying for a position on the wagering game leaderboard. The sponsor may set criteria for receiving rewards and triggering the game-based events. The sponsor may also control rewards associated with the game-based events, a number of reward credits associated with the reward/game-based event, etc. For example, a beverage company sponsor may set rules that indicate that the player should accumulate at least N beverage symbols to be a contender for a position on the wagering game leaderboard. The rules may indicate that player should be awarded X beverage symbols for getting a specified game-based event and Y beverage symbols for receiving a specified reward. The flow continues at block 410.

At block 410, it is determined whether the player qualifies for a position on the wagering game leaderboard. In some implementations, the sponsor may determine criteria that the player should satisfy in order to qualify for a position on the wagering game leaderboard. The sponsor may quantify success in terms of a number of reward credits, number of wins, game-based events, etc. The player's game play behavior and number of reward credits accrued may be evaluated to determine whether the player qualifies for a position on the wagering game leaderboard. In one implementation, the number of reward credits accumulated by the player may be compared against a threshold number of reward credits required to qualify for a position on the wagering game leaderboard. For example, it may be determined that Jim with 500 game points exceeds the requisite threshold of 200 game points and therefore qualifies for a position on the wagering game leaderboard. As another example, it may be determined that Bob with wagering game winnings of $200 does not meet the threshold amount of $500 and therefore does not qualify for a position on the wagering game leaderboard. In some implementations, the rewards received at block 404 may also be considered while determining the player's position on the wagering game leaderboard. For example, Jill may receive 500 game points for winning an online poker tournament and 50 rounds of free game play as a reward. It may be determined that the 50 rounds of free game play is equivalent to 100 game points, thus giving Jill 600 game points for the wagering game. Jill's 600 game points may be compared against a predetermined threshold or against a number of game points associated with other players on the wagering game leaderboard to determine if Jill qualifies for a position on the wagering game leaderboard. If it is determined that the player qualifies for a position on the leaderboard, the flow continues at block 412. Otherwise, the flow continues at block 414.

At block 412, the wagering game leaderboard is updated to reflect the player achieving one of the top positions in the wagering game. The player's position on the wagering game leaderboard may be determined by comparing the player's reward credits with the reward credits of other players on the wagering game leaderboard. In some implementations, the player may receive a reward for qualifying for the position on the wagering game leaderboard. For example, a beverage company sponsoring the wagering game leaderboard may present the players on the wagering game leaderboard with a case of beverages. As another example, a gaming software company may reward a top three players on the wagering game leaderboard with a tour of the company and an opportunity to meet with game designers. In some implementations, the player may also be notified of a number of reward credits (e.g., game points, money, symbols, etc.) required to achieve a next reward. The player may also be reminded, at regular intervals, of a number of reward credits required to achieve a higher position on the wagering game leaderboard. For example, Bob in fifth position on the wagering game leaderboard may receive an indication that he is 50 game points away from Jim, currently in fourth position. From block 412, the flow ends.

At block 414, an indication of a number of reward credits required to qualify for a position on the wagering game leaderboard is presented. From block 414, the flow ends.

Figure 5:
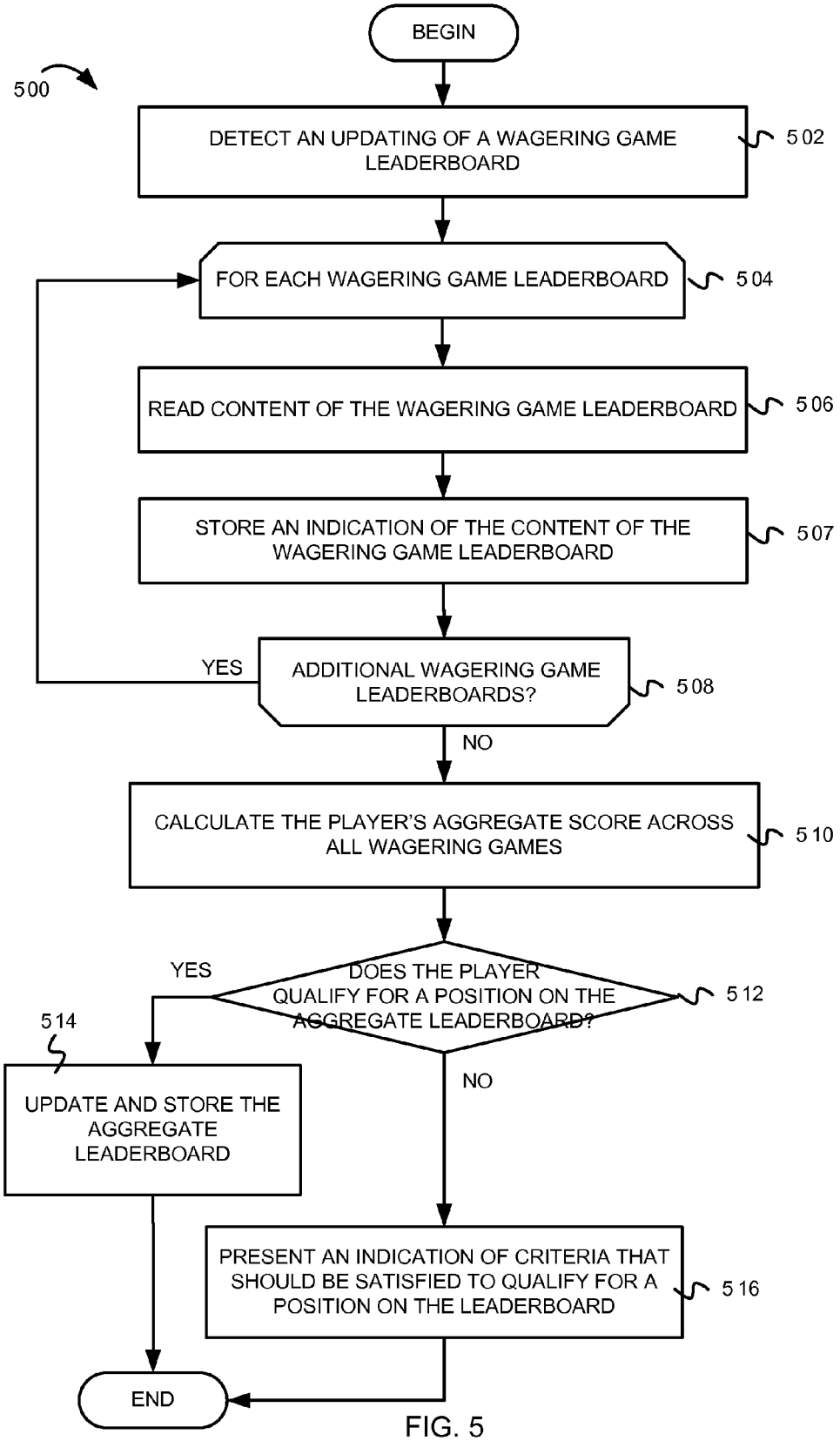
FIG. 5 is a flow diagram illustrating example operations for maintaining an aggregate leaderboard.

FIG. 5 is a flow diagram illustrating example operations for maintaining an aggregate leaderboard. Flow 500 begins at block 502.

At block 502, an updating of a wagering game leaderboard is detected. A leaderboard management server associated with the wagering game leaderboard may generate a notification indicating the updating of the wagering game leaderboard. In some implementations, content of the wagering game leaderboard may be monitored to determine the updating of the wagering game leaderboard. The flow continues at block 504.

At block 504, a loop is begun to perform a set of operations (described in blocks 506 and 507) on each of the wagering game leaderboards. Content of the wagering game leaderboards is read to create an aggregate leaderboard across all of the wagering game leaderboards. Each of the wagering game leaderboards is associated with a respective single wagering game. However, the aggregate leaderboard is a summary of the wagering game leaderboards and can indicate overall standings or player rankings across multiple wagering games (e.g., online wagering games hosted on a casino's website, wagering games played on physical wagering game machines in the casino, etc.). At block 504, it is also determined whether there exists another wagering game leaderboard from which the content should be read in order to create the aggregate leaderboard. A next wagering game leaderboard is identified and the loop executes for the next wagering game leaderboard. For each of the wagering game leaderboards, the flow continues at block 506.

At block 506, the content of the wagering game leaderboard is read. The content of the wagering game leaderboard can comprise player names, player identifiers, positions of the players on the wagering game leaderboard, a number of reward credits accumulated by each player, a monetary value of each of the player's winnings, a number of rewards earned by each of the players, etc. Additionally, player identification information (e.g., player name, game identifier, etc.) and player gaming data describing game play behavior may also be determined (e.g., by accessing a player account server). The game play behavior can include frequency and length of game play, number of wins and losses, average amount wagered over an interval of time, etc. The flow continues at block 507.

At block 507, an indication of the content of the wagering game leaderboard is stored. In one implementation, entire content of the wagering game leaderboard may be stored. In another implementation, updates of the wagering game leaderboard (e.g., differences from a last stored content of the wagering game leaderboard) may be stored. The indication of the content of the wagering game leaderboard may be stored in a temporary memory location while the aggregate leaderboard is being updated/created. In some implementations, the indication of the content of the wagering game leaderboard may be permanently stored in a designated location for future reference (e.g., to determine a next set of updates after an interval of time). For example, a history of content of the wagering game leaderboard may be stored to determine player positions on the aggregate leaderboard. Additionally, the player identification information and player gaming data may also be stored. The flow continues at block 508.

At block 508, the loop for each of the wagering game leaderboards ends. If there are additional wagering game leaderboards, then control flows back to block 504, where the next wagering game leaderboard is identified and the operations described with reference to block 506 are performed for the next wagering game leaderboard. The loop ends and the flow continues at block 510 after it is determined that the loop operations (block 506 and 507) have been performed for every wagering game leaderboard.

At block 510, the player's aggregate score across all the wagering games is calculated. In calculating the aggregate score, it may be determined whether the player qualifies for a position on the aggregate leaderboard. The player's aggregate score may be calculated based on the content read from each of the wagering game leaderboards. Additionally, the player's aggregate score may also be influenced by the player's game play behavior. Credits may be awarded to the players based on the players' game play behavior. For example, players may receive a credit for each wagering game that they play. The aggregate score for each player may be calculated as a combination (e.g., a sum, a weighted sum, etc.) of credits from each of the wagering games (e.g., determined from the content of the wagering game leaderboards), game play behavior, etc. In some implementations, the aggregate score may be calculated by mapping the content of the wagering game leaderboards and the game play behavior to content of the aggregate leaderboard. For example, an expression (e.g., aggregate leaderboard position=aggregate score/100) may define the mapping. Also, because different wagering game leaderboards may use different metrics for indicating reward credits, the metrics across the wagering game leaderboards may be normalized. For example, one wagering game leaderboard metric may be a monetary value, another wagering game leaderboard metric may be car symbols, the aggregate leaderboard metric may be game points, etc. The player's reward credits may be converted from the wagering game leaderboard metric (e.g., car symbols) into the aggregate leaderboard metric (e.g., game points) for easier calculation and comparison. For example, it may be determined that $10 is equivalent to 1 game point, 20 car symbols is equivalent to 1 game point, and so on. The casino or a third party sponsor sponsoring the aggregate leaderboard may determine the aggregate leaderboard metric, inter-metric conversion principle, etc.

In some implementations, instead of calculating a total number of accumulated reward credits and converting from one wagering game leaderboard metric to another, the aggregate leaderboard can be created by assigning a score based on the player's position on individual wagering game leaderboards. For example, a player in first position may be awarded 10 points, a player in second position may be awarded 9 points, and so on. The number of points may be added across each of the wagering game leaderboards to calculate the aggregate score. In other words, the player in first position on one wagering game leaderboard and second position on another wagering game leaderboard may receive an aggregate score of 19 points.

In some implementations, the sponsor may distribute marketing offers based on the player's aggregate score. For example, a reward may be presented to the player that is most active across multiple wagering games. In some implementations, the aggregate score may be calculated across multiple online wagering games (e.g., presented on the casino's website). In another implementation, the aggregate score may be calculated across the multiple online wagering games and the wagering games played in the casino.

In some implementations, reward credits from non-wagering game activity may also be taken into consideration while calculating the aggregate score. For example, the player may receive 100 credits for registering with the casino's gaming website to play online wagering games. As another example, the player may receive 50 credits for subscribing to a poker magazine sponsored by the casino. As another example, the player may receive 500 credits for signing up for a casino credit card, staying in the casino's hotel, or visiting one of the casino's restaurants. After the player's aggregate score is calculated, the flow continues at block 512.

At block 512, it is determined whether the player qualifies for a position on the aggregate leaderboard. The player's aggregate score and various other player behaviors may be used to determine whether the player qualifies for a position on the aggregate leaderboard. In some implementations, a player account may also be accessed to determine the player's game play behavior. For example, a frequency and length of game play, a number of wins and losses, frequency of fulfillment of game based events, wagered amount, a percentage of the wagered amount won, a number of consecutive spins, etc. may also be determined. The player's game play history, achievement level, and skill level may also be taken into consideration when determining whether the player qualifies for a position on the aggregate leaderboard. For example, the player's game play history over a past year, the player's progress rate (e.g., how fast the player progressed through various game levels), the player's wagering history (e.g., whether the player has increased his/her wagers over the past six months), etc. may influence the player's position on the aggregate leaderboard.

In some implementations, the player account may be accessed for the player's game play behavior only if the player satisfies certain conditions. For example, the player's game play behavior may be determined if the player's aggregate score is greater than a threshold score. As another example, the player's game play behavior may be determined to resolve a tie between two players with the same aggregate score.

In some implementations, a number of available positions on the aggregate leaderboard may be predetermined. In another implementation, the number of available positions on the aggregate leaderboard may vary depending on a total number of players playing the wagering games. The players may be ranked in descending order of their aggregate scores and the set of players that qualify for a position on the aggregate leaderboard may be determined. For example, the top 1% of the players (across online and casino based wagering games) may be placed on the aggregate leaderboard. As another example, N of the top ranked players may be placed on the aggregate leaderboard. If it is determined that the player qualifies for a position on the aggregate leaderboard, the flow continues at block 514. Otherwise, the flow continues at block 516.

At block 514, the aggregate leaderboard is updated and stored. The aggregate leaderboard may be updated to reflect top N players across all of the wagering games. In some implementations, a subset of players may be placed on the aggregate leaderboard in accordance with criteria associated with the aggregate leaderboard. As mentioned earlier, the aggregate leaderboard may also reflect game play behavior and history. In some implementations, criteria for achieving a higher position on the aggregate leaderboard may also be presented (e.g., on the player's computer system, wagering game machine, etc). In some implementations, entire content of the aggregate leaderboard may be stored. In another implementation, differences between the aggregate leaderboard and a past version of the aggregate leaderboard may be stored. From block 514, the flow ends.

At block 516, an indication of criteria that should be satisfied to qualify for a position on the aggregate leaderboard is presented. The flow 500 moves from block 512 to block 516 after it is determined that the player does not qualify for a position on the aggregate leaderboard. The criteria to qualify for a position on the aggregate leaderboard may be determined and presented to the player. For example, it may be determined that the player must accumulate 200 game points to qualify for a position on the aggregate leaderboard. From block 516, the flow ends.

Figure 6:
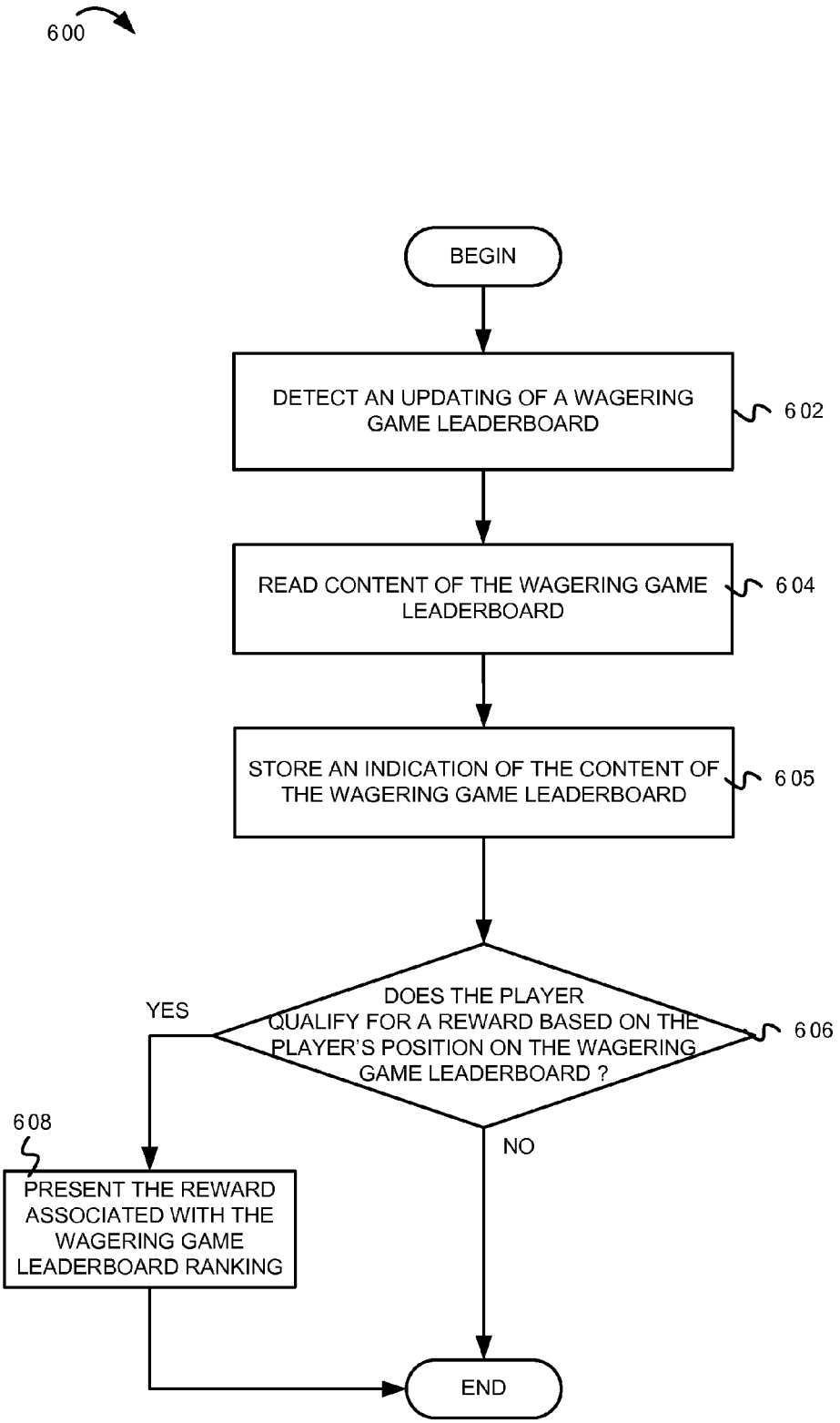
FIG. 6 is a flow diagram illustrating example operations for presenting rewards based on wagering game leaderboard ranking.

FIG. 6 is a flow diagram illustrating example operations for presenting rewards based on wagering game leaderboard ranking Flow 600 begins at block 602.

At block 602, an updating of a wagering game leaderboard is detected. A leaderboard management server associated with the wagering game leaderboard may generate a notification indicating the updating of the wagering game leaderboard. In some implementations, content of the wagering game leaderboard may be monitored to determine the updating of the wagering game leaderboard. The flow continues at block 604.

At block 604, content of the wagering game leaderboard is read. Player information, such as player names, player identifiers, number of reward credits accumulated by each player, etc. may be determined by reading the content of the wagering game leaderboard. The players' position on the wagering game leaderboard may also be determined. The flow continues at block 605.

At block 605, an indication of the content of the wagering game leaderboard is stored. In one implementation, the content of the wagering game leaderboard may be stored temporarily while the content of the wagering game leaderboard is being processed (e.g., as described with reference to block 606). In some implementations, entire current content of the wagering game leaderboard may be stored, while in other implementations differences between the current content and a past content of the wagering game leaderboard may be stored. The flow continues at block 606.

At block 606, it is determined whether the player qualifies for a reward based on the player's position on the wagering game leaderboard. In addition to the wagering game leaderboard depicting a current status of the wagering game (e.g., based on reward credits accumulated while playing the wagering game), players ranked on the wagering game leaderboard may also vie for rewards associated with wagering game leaderboard ranking Each position on the wagering game leaderboard may be associated be a different number of ranking credits. For example, a player in first position on the wagering game leaderboard may receive 20 ranking credits; a player in second position may receive 18 ranking credits, and so on. Additionally, ranking credits may be added or subtracted depending on fluctuations in the player's position on the wagering game leaderboard. For example, a drop in one position on the wagering game leaderboard may result in a deduction of one ranking credit while an increase in one position may result in an addition of two ranking credits. A leaderboard management server may calculate the ranking credits to determine players that qualify for rewards associated with wagering game leaderboard ranking. The rewards associated with the wagering game leaderboard ranking may be awarded every set interval of time (e.g., every 12 hours, every week, etc). A leaderboard management server may calculate the ranking credits to determine players that qualify for rewards associated with wagering game leaderboard ranking.

In some implementations, outcomes of the wagering games may be influenced based on whether the player playing the wagering game is on a leaderboard (e.g., an aggregate leaderboard, a wagering game leaderboard, etc.), an amount of time the player has been on the leaderboard, the player's position on the leaderboard, etc. For example, a player may be permitted to access and play a higher game level in the wagering game if it is determined that the player is on the aggregate leaderboard. A wagering game server that hosts the wagering game may access content of the aggregate leaderboard, determine whether the player is on the aggregate leaderboard, and accordingly permit the player to move to a higher game level in the wagering game. In some implementations, the player may receive additional game credits (e.g., game points) if the player is ranked on the aggregate leaderboard. In some implementations, the player may receive a set number of additional game credits irrespective of his/her position on the aggregate leaderboard. In other implementations, the number of additional game credits awarded to the player may vary depending on the player's position on the aggregate leaderboard. For example, after Bob completes five levels of the wagering game, the wagering game server may determine, e.g., based on reading the content of the aggregate leaderboard, that Bob is ranked "1" on the aggregate leaderboard. Based on reward rules associated with the wagering game Bob may be awarded an additional e.g., 500 game credits. Likewise, Jim in $2^{nd}$ position on the aggregate leaderboard may receive an additional, e.g., 400 game credits after completing the five levels of the wagering game. As another example, the player may receive rewards, access to higher game levels, access to special privileges associated with the wagering game (e.g., extra rounds of game play, codes to unlock higher game levels, etc.) based on his/her position on the aggregate leaderboard.

The player may also receive the above-described rewards if the player maintains his/her position on the aggregate leaderboard for a specified amount of time. For example, the player may receive additional game credits if the player maintains his/her position on the aggregate leaderboard for three consecutive days. The rewards associated with the wagering game leaderboard ranking may be awarded every set interval of time (e.g., every 12 hours, every week, etc.). If it is determined that player qualifies for the reward based on the player's position on the wagering game leaderboard, the flow continues at block 608. Otherwise, the flow ends.

At block 608, the reward associated with the wagering game leaderboard ranking is presented to the player. As described earlier, the rewards may be casino-based rewards or sponsor-based rewards. The sponsor may determine the type of reward, number of rewards to be awarded, etc. For example, it may be determined that three players with the highest number of ranking credits should receive the rewards. In some implementations, a wagering game server and/or a web server may be directed to present the reward on the player's computer system. In other implementations, the player's account in a player account server may be updated to reflect the player receiving the reward associated with the wagering game leaderboard ranking A notification (e.g., an email notification, an instant message, etc) of the reward may be sent to the player. From block 608, the flow ends.

Figure 7:
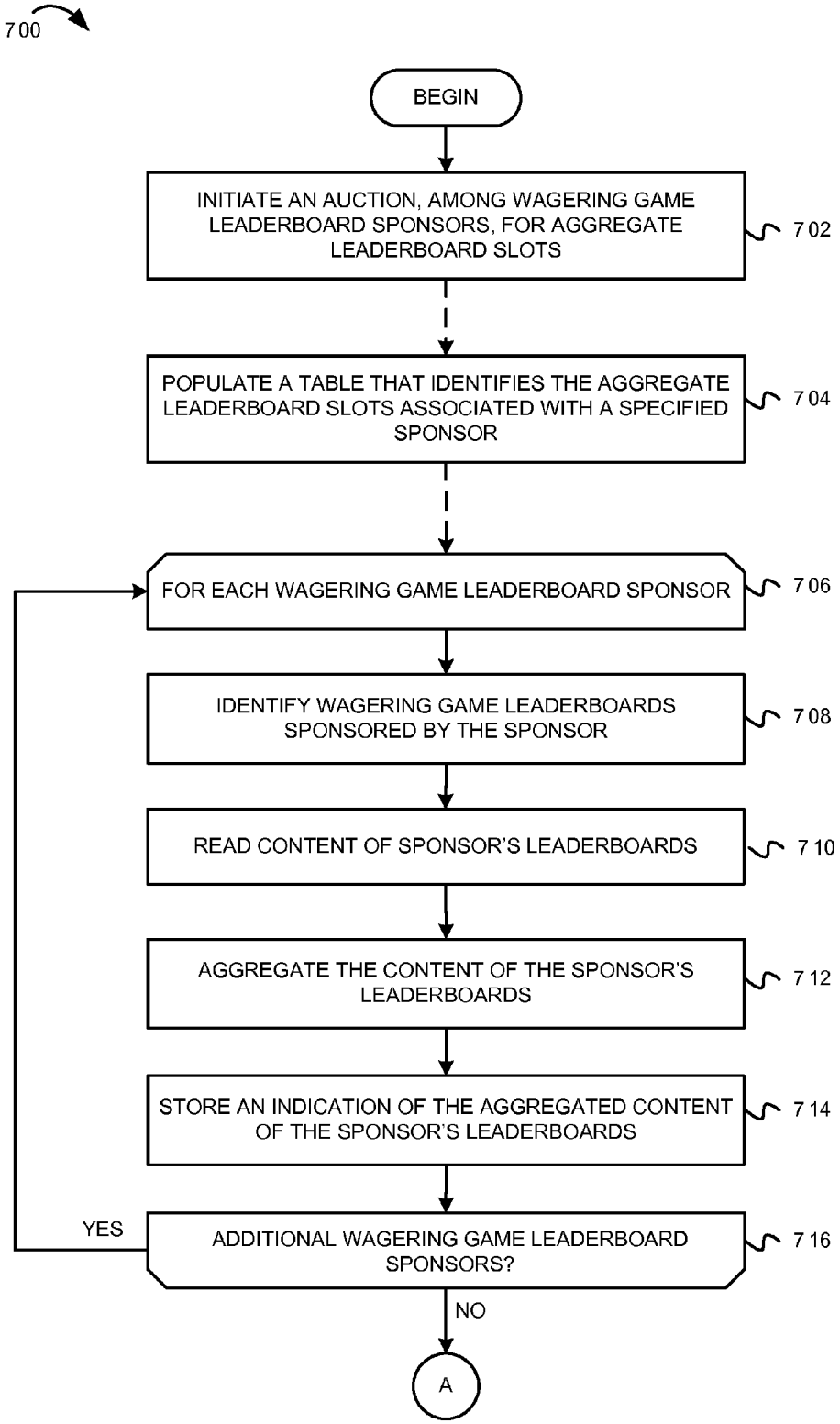
FIG. 7 depicts a flow diagram illustrating example operations maintaining a multi-sponsor aggregate leaderboard.
Figure 8:
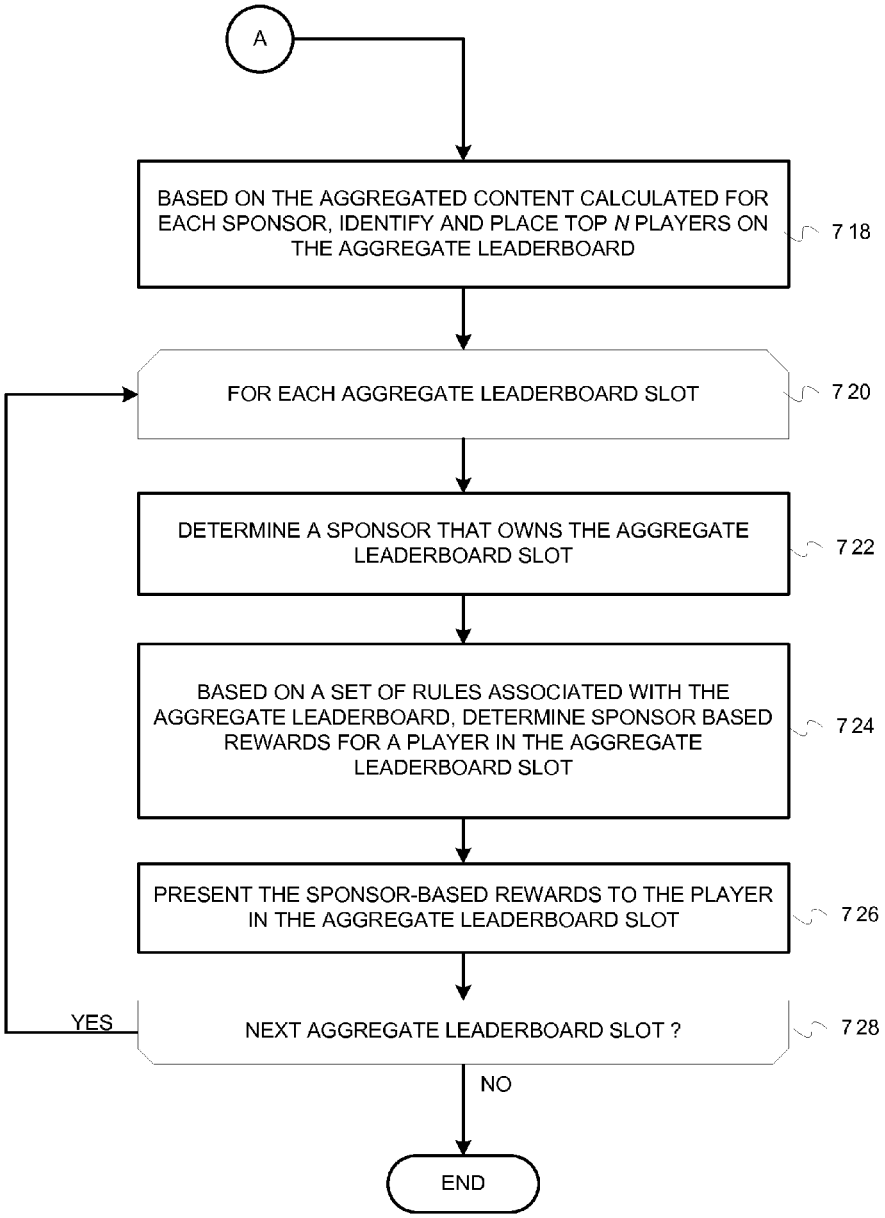
FIG. 8 depicts a flow diagram illustrating example operations that continue from FIG. 7.

FIGS. 7 and 8 depict a flow diagram illustrating example operations of another embodiment for maintaining an aggregate leaderboard. Flow 700 begins at block 702 in FIG. 7.

At block 702, an auction is initiated, among wagering game leaderboard sponsors, for aggregate leaderboard slots. As described earlier, each wagering game may be associated with a wagering game leaderboard. Moreover, different sponsors may sponsor each of the wagering game leaderboards. The sponsors may use the wagering game leaderboards or wagering games associated with the wagering game leaderboards to promote their product and brand. Additionally, the sponsor may also set reward criteria, criteria for achieving game based events, criteria for achieving a position on the wagering game leaderboard, etc. The auction for the aggregate leaderboard slots may be initiated to allow sponsors to control certain slots (i.e., the slots won in the auction) of the aggregate leaderboard. The sponsors may reward players in their slots, display the player's name on an advertisement board, and present additional incentives for playing the wagering games sponsored by the sponsor and buying the sponsor's products. The auction may be initiated every set interval of time. In some implementations, a new auction for the aggregate leaderboard slots may be initiated a set interval of time before/after the aggregate leaderboard is updated. An auctioning server may receive the sponsor's bids and update a current bid value of the aggregate leaderboard slots until an allotted time for the auction ends. In lieu of an auction, a more static scheme may be implemented for assigning aggregate leaderboard slots to various sponsors. For example, sponsors may register for or pay a fixed value for requisite aggregate leaderboard slots without bidding for or competing for specific aggregate leaderboard slots. The flow continues at block 704.

At block 704, a sponsor-slot table that identifies aggregate leaderboard slots associated with each of the sponsors is populated. Content of the sponsor-slot table may be overwritten to reflect new aggregate leaderboard slots won by the sponsors. The sponsor-slot table can indicate a name of the sponsor, slot numbers identifying the aggregate leaderboard slots won by the sponsor, etc. The flow continues at block 706.

At block 706, a loop is begun to perform a set of operations (described in blocks 708 through 714) for each of the wagering game leaderboard sponsors to identify wagering game leaderboards sponsored by the sponsors and accordingly calculate an aggregate score for the players. At block 706, it is also determined whether there exists another wagering game leaderboard sponsor for which the corresponding wagering game leaderboards should be identified in order to calculate a sponsor-based aggregate score. A next wagering game leaderboard sponsor is identified and the loop executes for the next wagering game leaderboard sponsor. For each wagering game leaderboard sponsor, the flow continues at block 708.

At block 708, one or more wagering game leaderboards sponsored by the sponsor are identified ("sponsor's leaderboards"). The sponsor's leaderboards may be identified by accessing a leaderboard sponsors table. Alternately, the sponsor to wagering game leaderboard relationship may also be stored in a database, a structure, a file, etc. The flow continues at block 710.

At block 710, content of the sponsor's leaderboards is read. In one implementation, an aggregate leaderboard server (e.g., the aggregate leaderboard server 314 of FIG. 3) may read the content of the sponsor's leaderboard from a pre-defined memory location. In another implementation, the aggregate leaderboard server 314 may transmit a message to each leaderboard management server controlling respective ones of the sponsor's leaderboard and request the content of the sponsor's leaderboard. The flow continues at block 712.

At block 712, content of the sponsor's leaderboards is aggregated. For example, if the sponsor sponsors four wagering game leaderboards, an aggregate score for a player may be calculated by summing reward credits accumulated by the player over the four wagering game leaderboards. Additionally, reward credits from one leaderboard metric may be converted into to a metric of the aggregate leaderboard or the reward credits may be normalized to ensure proper calculation of the aggregate score for each player. The flow continues at block 714.

At block 714, an indication of aggregated content of the sponsor's leaderboards is stored for each of the players. For example, a player name or other player identifier and a corresponding aggregate score may be stored. The indication of the aggregated content of the sponsor's leaderboards may be stored in a temporary memory location while the aggregate leaderboard is being updated/created. The flow continues at block 716.

At block 716, the loop for each of the wagering game sponsors ends. If there are additional wagering game sponsors, then control flows back to block 706, where the next wagering game sponsor is identified and the operations described with reference to blocks 708 through 714 are performed for the next wagering game sponsor. The loop ends when it is determined that the loop operations (blocks 708 through 714) have been performed for every wagering game sponsor. After the loop ends, the flow continues at block 718 in FIG. 8.

At block 718, top N players are identified and placed on the aggregate leaderboard. The top N players are identified based on comparing aggregate scores calculated as a result of aggregating content for the sponsor's leaderboards for each of the wagering game sponsors. The top N players may be ranked in decreasing order of their aggregate scores. Because the aggregate scores for the players are calculated on a sponsor-by-sponsor basis, the same player may be placed at multiple positions on the aggregate leaderboard. For example, a player may be ranked "1" because of an aggregate score calculated using content of a first sponsor's leaderboards. The same player may be ranked "3" on the aggregate leaderboard because of another aggregate score calculated using content of a second sponsor's leaderboards. The flow continues at block 720.

At block 720, a second loop is begun to perform a set of operations (described in blocks 722 through 726) for each aggregate leaderboard slot to identify sponsors that own (e.g., through winning an auction) the aggregate leaderboard slot and accordingly present sponsor rewards to players in the aggregate leaderboard slot. At block 720, it is also determined whether there exists another aggregate leaderboard slot for which the player in the aggregate leaderboard slot should be identified and rewarded. A next aggregate leaderboard slot is identified and the loop executes for the next aggregate leaderboard slot. For each aggregate leaderboard slot, the flow continues at block 722.

At block 722, a sponsor that owns the aggregate leaderboard slot is identified. For example, the sponsor-slot table may be accessed to determine the sponsor that owns the aggregate leaderboard slot. The flow continues at block 724.

At block 724, sponsor-based rewards for a player in the aggregate leaderboard slot are identified. The sponsor-based rewards may be determined based on a set of rules associated with the aggregate leaderboard. Alternately, the sponsor-based rewards may be determined based on querying a rewards unit, a database, a table, etc. set up by the sponsor to keep track of and indicate rewards that should be presented to the players. The flow continues at block 726.

At block 726, the sponsor-based reward is presented to the player in the aggregate leaderboard slot. For example, the player may receive game credits, sponsor products, and other such rewards sponsored by the sponsor. For example, the player in the aggregate leaderboard slot may receive an all-expense paid vacation. As another example, the player in the aggregate leaderboard slot may be featured on the sponsor's website. As another example, the sponsor may place a photograph or avatar of the player on the sponsor's advertising board in the casino. The player in the aggregate leaderboard slot may be awarded a title such as "Sponsor's player of the week" to encourage the player to keep playing the wagering games and buy the sponsor's products. The reward presented to the player may be based on the player's ranking on the aggregate leaderboard. For example, the sponsor may have won, in the auction, aggregate leaderboard slots 3 and 5. A congratulatory message with the name of the player in third position may be displayed on the sponsor's advertisement board for two minutes, while the congratulatory message with the name of the player in fifth position may be displayed for one minute. The flow continues at block 728.

At block 728, the loop for each of the aggregate leaderboard slots ends. If there are additional aggregate leaderboard slots, then control flows back to block 720, where the next aggregate leaderboard slot is identified and the operations described with reference to blocks 722 through 726 are performed for the next aggregate leaderboard slot. The loop and the flow ends when it is determined that the loop operations (blocks 722 through 726) have been performed for every aggregate leaderboard slot.

It should be noted that although FIG. 5 depicts the aggregate leaderboard being updated every time the updating of the wagering game leaderboard is detected, in some implementation, updating the aggregate leaderboard might not be tied to updating the wagering game leaderboard. In some implementations, the aggregate leaderboard may be updated at regular time intervals independent of whether or not the wagering game leaderboards are updated. For example, wagering game leaderboards may be updated every time game-based events are detected, while the aggregate leaderboard may be updated every two hours.

Also, FIG. 7 depicts calculation of the aggregate score on a sponsor-by-sponsor basis and updating the aggregate leaderboard soon after initiating the auction and populating the sponsor-slot table. However, in some implementations, the process of auctioning the aggregate leaderboard slots may be performed independent of the process of calculating the aggregate score and updating the aggregate leaderboard. It should also be noted, that in some implementations, the aggregate score might not be calculated on a sponsor-by-sponsor basis. The aggregate score may be calculated across all wagering game leaderboards (as described with reference to FIG. 5) and the players on the aggregate leaderboard may receive rewards from sponsors who have won/registered for the aggregate leaderboard slots.

FIGS. 1-8 describe wagering game leaderboards associated with wagering games. However, leaderboards may be created based on any suitable criteria—not necessarily a number of reward credits earned from rewards or game-based events. In some implementations, the casino may also host leaderboards for representing game play behavior. For example, one leaderboard may indicate top N players who have wagered the most money in one or more wagering games, another leaderboard may indicate top M players who have won the most number of wagering games, etc. The leaderboards may also be created for various wagering game challenges and tournaments. For example, a casino may define a "big win" as an achievement level where the player wins more than twenty-five times the wagered amount. A "big win leaderboard" can indicate the top N players who have achieved the big win. A wagering game may also be associated with multiple wagering game leaderboards. For example, in addition to a wagering game leaderboard that identifies the top N players with the highest reward credits, the wagering game may be associated with another wagering game leaderboard that indicates the player's achievement level in the wagering game bonus round.

Also, although the FIGS. 1-8 describe gaming activity (e.g., playing the wagering games, generating a game based event, game play behavior, etc.) being used to distribute reward credits and determine position on the wagering game leaderboard; in some implementations, the players may receive credits and rewards for non-gaming activity. For example, the player may receive reward credits or become eligible to play a next level in an online wagering game, after completing a survey, providing feedback on an advertisement, sending the advertisement to a certain number of friends, locating hidden symbols in a mobile phone based wagering game, etc. Additionally, wagering game reward credits, positions on leaderboards, etc. may not be exclusively linked to wagering game-based activities. Players may be required to play other forms of online games (e.g., strategy based games such as online chess, word games, etc.) on a personal computer, a laptop, a mobile phone, etc. to qualify for certain rewards or special privileges associated with the wagering games. The online games may be games created by an online game sponsor of the wagering game leaderboard. For example, a player may be required to log on to a gaming website and play a specified race car game for 2 consecutive days in order to unlock or gain access to a higher level in a wagering game. Activity from playing the online games may also be used to rank players on the wagering game leaderboards, the aggregate leaderboard, and/or other leaderboard designed specifically for the online game activity. For example, players may receive credits based on a number of hours or consecutive days the players play the online games, a number of points or other credits won in the playing the online games, a number of levels of the online game that were played, etc. Alternately, a player may be required to play a specified wagering game for N consecutive days, collect M reward credits, etc. in order to gain access to special features of an online game (e.g., unlock a higher level of the online game, gain access to a bonus round, etc.)

Also, sponsors typically use the leaderboards (e.g., the aggregate leaderboard, the wagering game leaderboards, etc.) to advertise their product by placing a name or picture of the sponsor's product, the sponsor's logo, catchphrase, slogan, etc. In addition to placing product symbols and sponsor brands on the wagering game leaderboards, the wagering game leaderboards may also comprise advertisements, links to the sponsor's website, links to surveys about the sponsor's products, etc. For example, a sponsored leaderboard in the casino may include an embedded advertisement (e.g., a multimedia clip advertising the sponsor's product) on a part of the leaderboard or as part of the leaderboard background. As another example, a sponsored leaderboard presented for an online wagering game may comprise the embedded advertisement and/or a link to the advertisement.

In some implementations, the casino can collaborate with sponsors and other wagering game providers to determine and identify trends in the player's game play behavior. This can help determine success of the online wagering game, influence of the wagering game leaderboard, sponsorship, and rewards on wagering game play, and impact of the sponsor/advertiser on the wagering game.

Operating Environment

This section describes an example operating environment and presents structural aspects of some embodiments. This section includes discussion about wagering game networks and wagering game machine architectures.

Wagering Game Networks

Figure 9:
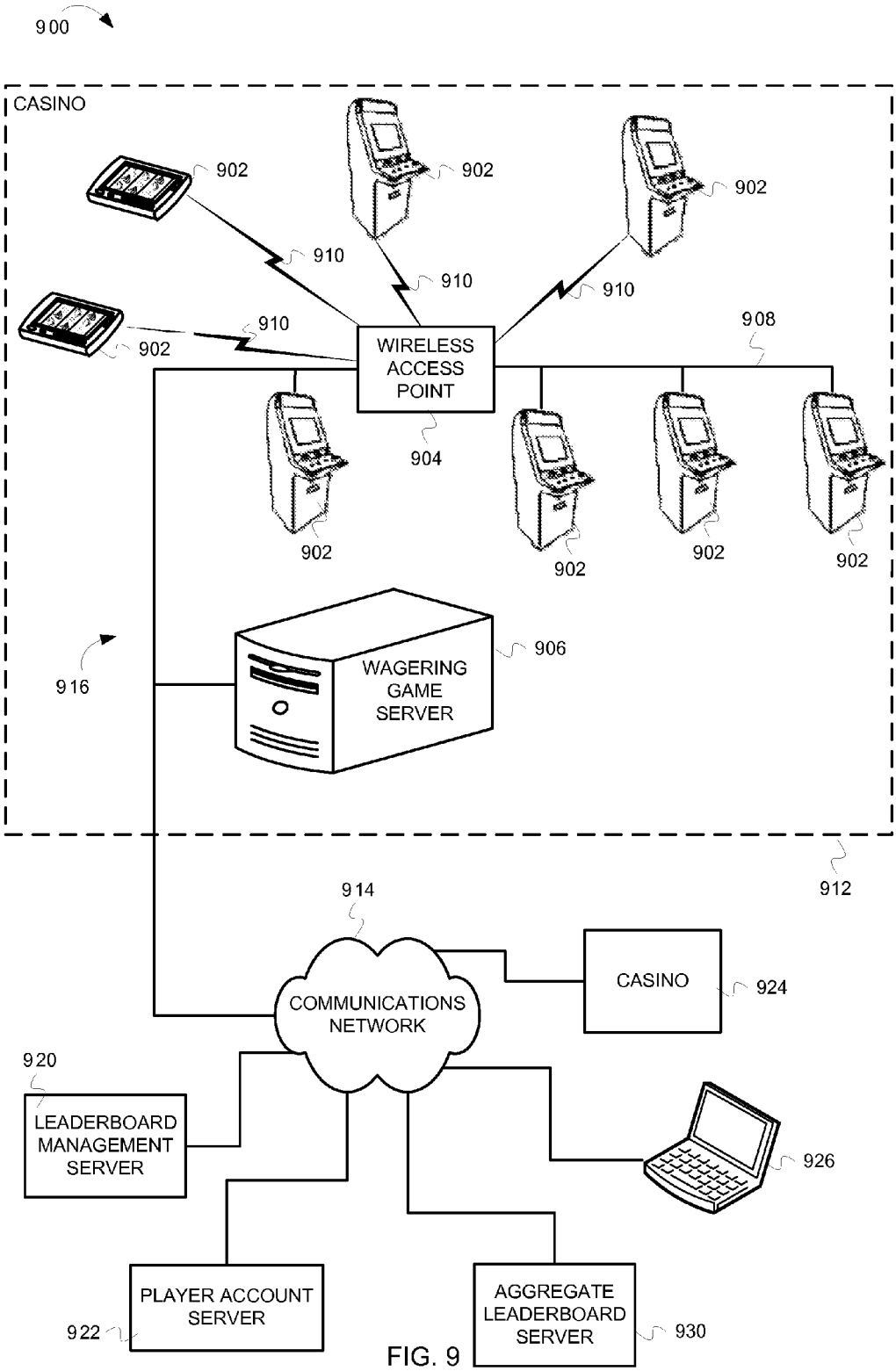
FIG. 9 is a block diagram illustrating a wagering game network, according to example embodiments of the invention.

FIG. 9 is a block diagram illustrating a wagering game network 900, according to example embodiments of the invention. As shown in FIG. 9, the wagering game network 900 includes casinos 912 and 924 connected to a communications network 914.

Each casino e.g., 912 includes a local area network 916, which includes an access point 904, a wagering game server 906, and wagering game machines 902. The access point 904 provides wireless communication links 910 and wired communication links 908. The wired and wireless communication links can employ any suitable connection technology, such as Bluetooth, 802.11, Ethernet, public switched telephone networks, SONET, etc. In some embodiments, the wagering game server 906 can serve wagering games and distribute content to devices located in other casinos 912 or at other locations on the communications network 914. FIG. 9 also depicts a leaderboard management server 920, and aggregate leaderboard server 930, a player account server 922, and a laptop 926 communicating via the communications network 914.

In addition to controlling wagering games played in the casino 912, the wagering game server 926 also keeps track of and hosts online wagering games. A player uses the laptop 926 to play the online wagering games hosted by the wagering game server 906. It should be noted that the player might use any suitable electronic device such as a personal computer, mobile phone, etc. to play the online wagering games.

The leaderboard management server 920 controls a leaderboard associated with a wagering game. Each wagering game may be associated with a distinct wagering game leaderboard, which may be controlled by a distinct leaderboard management server. On determining a game-based event, the leaderboard management server 920 can determine a number of reward credits associated with the game-based event, determine whether the player qualifies for a position on the wagering game leaderboard, and accordingly update the wagering game leaderboard.

The aggregate leaderboard server 930 controls an aggregate leaderboard that indicates overall rankings across all the online wagering games. In some implementations, the aggregate leaderboard server 930 may be configured to include wagering games played on the wagering game machines 902 in the casino 912 while determining content of the aggregate leaderboard. The aggregate leaderboard server 930 can receive content of the wagering game leaderboards from the leaderboard management server 920. The aggregate leaderboard server 930 can identify players that qualify for a position on the aggregate leaderboard based on rankings on individual wagering game leaderboards, game play behavior, etc. and accordingly update the aggregate leaderboard. Player information (e.g., player identifiers) and game play behavior may be stored in the player account server 922. The player account server 922 may store game play history, a history of amounts wagered, won, or lost, a ratio of wins to losses, frequency of game play, etc. In some implementations, the player account server 922 may also store a number of reward credits won for each of the wagering games played, positions on each of the wagering game leaderboards, aggregate scores, position on the aggregate leaderboard, a record of received rewards, etc.

The wagering game machines 902 described herein can take any suitable form, such as floor standing models, handheld mobile units, bartop models, workstation-type console models, etc. Further, the wagering game machines 902 can be primarily dedicated for use in conducting wagering games, or can include non-dedicated devices, such as mobile phones, personal digital assistants, personal computers, etc. In one embodiment, the wagering game network 900 can include other network devices, such as accounting servers, wide area progressive servers, player-tracking servers, and/or other devices suitable for use in connection with embodiments of the invention.

In some embodiments, wagering game machines 902 and wagering game servers 906 work together such that a wagering game machine 902 can be operated as a thin, thick, or intermediate client. For example, one or more elements of game play may be controlled by the wagering game machine 902 (client) or the wagering game server 906 (server). Game play elements can include executable game code, lookup tables, configuration files, game outcome, audio or visual representations of the game, game assets, or the like. In a thin-client example, the wagering game server 906 can perform functions such as determining game outcome or managing assets, while the wagering game machine 902 can present a graphical representation of such outcome or asset modification to the user (e.g., player). In a thick-client example, the wagering game machines 902 can determine game outcomes and communicate the outcomes to the wagering game server 906 for recording or managing a player's account.

In some embodiments, either the wagering game machines 902 (client) or the wagering game server 906 can provide functionality that is not directly related to game play. For example, account transactions and account rules may be managed centrally (e.g., by the wagering game server 906) or locally (e.g., by the wagering game machine 902). Other functionality not directly related to game play may include power management, presentation of advertising, software or firmware updates, system quality or security checks, etc.

Any of the wagering game network components (e.g., the wagering game machines 902) can include hardware and machine-readable media including instructions for performing the operations described herein.

Wagering Game Machine Architectures

Figure 10:
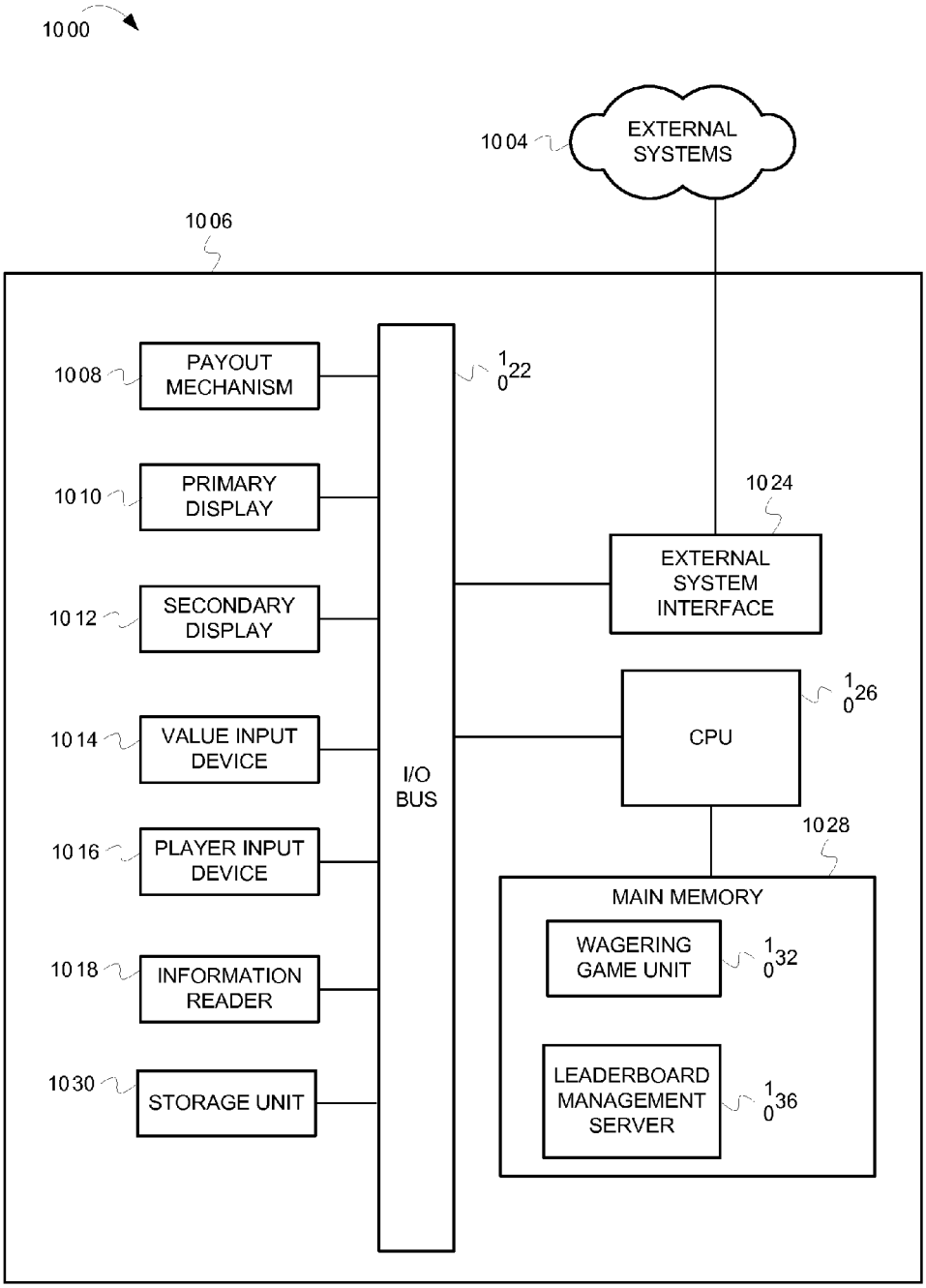
FIG. 10 is a block diagram illustrating wagering game machine architecture, according to example embodiments of the invention.

FIG. 10 is a block diagram illustrating wagering game machine architecture, according to example embodiments of the invention. As shown in FIG. 10, the wagering game machine architecture 1000 includes a wagering game machine 1006, which includes a central processing unit (CPU) 1026 connected to main memory 1028. The CPU

1026 can include any suitable processor, such as an Intel® Pentium processor, Intel® Core 2 Duo processor, AMD Opteron™ processor, or UltraSPARC processor. The main memory 1028 includes a wagering game unit 1032 and a leaderboard presentation unit 1036. In one embodiment, the wagering game unit 1032 can present wagering games, such as video poker, video black jack, video slots, video lottery, etc., in whole or part. The leaderboard presentation unit 1036 can interface with a leaderboard management server (e.g., the leaderboard management server 102 of FIG. 1) to present a current content of the wagering game leaderboard associated with a wagering game being played on the wagering game machine 1006.

The CPU 1026 is also connected to an input/output (I/O) bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems 1004 (e.g., wagering game networks).

In one embodiment, the wagering game machine 1006 can include additional peripheral devices and/or more than one of each component shown in FIG. 10. For example, in one embodiment, the wagering game machine 1006 can include multiple external system interfaces 1024 and/or multiple CPUs 1026. In one embodiment, any of the components can be integrated or subdivided.

Any component of the architecture 1000 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method of operating a gaming system, said method comprising:

receiving, via a network communication interface of the gaming system, first data from a first wagering game associated with a first player, wherein the gaming system comprises a value input device configured to receive monetary value for placement of wagers on one or more casino wagering games, and wherein the first data comprises a first plurality of scores for the first player from a plurality of leaderboards for a plurality of types of games;

receiving, via the network communication interface, second data from a second wagering game associated with a second player, wherein a first type of game for the first wagering game is different from a second type of game for the second wagering game, wherein the second data comprises a second plurality of scores for the second player from the plurality of leaderboards for the plurality of types of games;

aggregating the first data and the second data;

computing rankings for the first player and the second player based, at least in part, on an aggregate of the first plurality of scores from the first data and an aggregate of the second plurality of scores from the second data; and updating an aggregate leaderboard based, at least in part, on the rankings for the first player and the second player, wherein the aggregate leaderboard is presented via an electronic display device associated with the gaming system.

2. The method of claim 1, further comprising:

aggregating the first data and the second data in response to determining that the first player meets a first threshold ranking on a first leaderboard for the first type of game and that the second player meets a second threshold ranking on a second leaderboard for the second type of game.

3. The method of claim 2, wherein the first leaderboard is from a first casino and wherein the second leaderboard is from a second casino.

4. The method of claim 2, further comprising:

aggregating the first data and the second data into the aggregate leaderboard in response to determining that the first leaderboard and the second leaderboard are sponsored by a same sponsor.

5. The method of claim 1, wherein the aggregating the first data and the second data comprises determining a first score from the first plurality of scores based on a position of the first player on a first leaderboard of the plurality of leaderboards associated with the first type of game, determining a second score from the first plurality of scores based on a position of the first player on a second leaderboard of the plurality of leaderboards associated with the second type of game, determining a third score from the second plurality of scores based on a position of the second player on the first leaderboard, and determining a fourth score from the second plurality of scores based on a position of the second player on the second leaderboard; wherein the computing the rankings for the first player and the second player comprises computing a first rank for the first player based on an aggregate of the first score and the second score, and computing a second rank for the second player based on an aggregate of the third score and the fourth score; and wherein the updating the aggregate leaderboard comprises ranking the first player and the second player on the aggregate leaderboard based on the first rank and the second rank.

6. The method of claim 1, wherein the first type of game is from a first wagering game manufacturer, and wherein the second type of game is from a second wagering game manufacturer.

7. The method of claim 1, wherein the aggregating the first data and the second data comprises:

determining a first type of metric for the first data;

determining a second type of metric for the second data;

converting the second type of metric to the first type of metric; and wherein the ranking the first player and the second player based, at least in part, on the aggregate of the first data and the second data comprises using the first type of metric to rank the first player and the second player on the aggregate leaderboard.

8. The method of claim 1 further comprising prolonging a wagering game event at a wagering game machine associated with the first player in response to determining that a rank of the first player on the aggregate leaderboard meets a threshold rank value.

9. A gaming system comprising:

a network communication interface;

a value input device configured to receive monetary value for placement of wagers on one or more casino wagering games;

an electronic display device;

an electronic processing unit; and a memory storage device configured to store instructions, which when executed by the electronic processing unit, cause the gaming system to perform operations to receive, via the network communication interface, first data from a first wagering game associated with a first player, wherein the first data comprises a first plurality of scores for the first player from a plurality of leaderboards for a plurality of types of games, receive, via the network communication interface, second data from a second wagering game associated with a second player, wherein a first type of game for the first wagering game is different from a second type of game for the second wagering game, and wherein the second data comprises a second plurality of scores for the second player from the plurality of leaderboards for the plurality of types of games, aggregate the first data and the second data, compute rankings for the first player and the second player based, at least in part, on an aggregate of the first plurality of scores from the first data and an aggregate of the second plurality of scores from the second data, and control an aggregate leaderboard based, at least in part, on the rankings for the first player and the second player, wherein the aggregate leaderboard is presented via the electronic display device.

10. The gaming system of claim 9, wherein the memory storage device is configured to store instructions, which when executed by the electronic processing unit, cause the gaming system to perform operations to:

aggregate the first data and the second data in response to determining that the first player meets a first threshold ranking on a first leaderboard for the first type of game and that the second player meets a second threshold ranking on a second leaderboard for the second type of game.

11. The gaming system of claim 10, wherein the memory storage device is configured to store instructions, which when executed by the electronic processing unit, cause the gaming system to perform operations to:

aggregate the first data and the second data into the aggregate leaderboard in response to determining that the first leaderboard and the second leaderboard are sponsored by a same sponsor.

12. The gaming system of claim 9, wherein the memory storage device is configured to store instructions, which when executed by the electronic processing unit, cause the gaming system to perform operations to:

determine a first score from the first plurality of scores based on a position of the first player on a first leaderboard of the plurality of leaderboards associated with the first type of game;

determine a second score from the first plurality of scores based on a position of the first player on a second leaderboard of the plurality of leaderboards associated with the second type of game;

determine a third score from the second plurality of scores based on a position of the second player on the first leaderboard;

determine a fourth score from the second plurality of scores based on a position of the second player on the second leaderboard;

compute a first rank for the first player based on an aggregate of the first score and the second score;

compute a second rank for the second player based on an aggregate of the third score and the fourth score; and rank the first player and the second player based on the first rank and the second rank.

13. The gaming system of claim 9, wherein the memory storage device is configured to store instructions, which when executed by the electronic processing unit, cause the gaming system to perform operations to:

determine a first type of metric for the first data;

determine a second type of metric for the second data;

convert the second type of metric to the first type of metric; and aggregate the first data and the second data using the first type of metric to rank the first player and the second player on the aggregate leaderboard.

14. The gaming system of claim 9, wherein the memory storage device is configured to store instructions, which when executed by the electronic processing unit, cause the gaming system to perform operations to prolong a wagering game event at a wagering game machine associated with the first player in response to determining that a rank of the first player on the aggregate leaderboard meets a threshold rank value.

15. A non-transitory, machine-readable storage medium having instructions stored thereon which, when executed by an electronic processing unit of a gaming system, cause the gaming system to perform operations comprising:

receiving, via a network communication interface of the gaming system, first data from a first wagering game associated with a first player, wherein the gaming system comprises a value input device configured to receive monetary value for placement of wagers on one or more casino wagering games, and wherein the first data comprises a first plurality of scores for the first player from a plurality of leaderboards for a plurality of types of games;

receiving, via the network communication interface, second data from a second wagering game associated with a second player, wherein a first type of game for the first wagering game is different from a second type of game for the second wagering game, wherein the second data comprises a second plurality of scores for the second player from the plurality of leaderboards for the plurality of types of games;

aggregating the first data and the second data;

computing rankings for the first player and the second player based, at least in part, on an aggregate of the first plurality of scores from the first data and an aggregate of the second plurality of scores from the second data; and updating an aggregate leaderboard based, at least in part, on the rankings for the first player and the second player, wherein the aggregate leaderboard is presented via an electronic display device associated with the gaming system.

16. The non-transitory, machine-readable storage medium of claim 15, said operations further comprising:

aggregating the first data and the second data in response to determining that the first player meets a first threshold ranking on a first leaderboard for the first type of game and that the second player meets a second threshold ranking on a second leaderboard for the second type of game.

17. The non-transitory, machine-readable storage medium of claim 16, said operations further comprising:

aggregating the first data and the second data into the aggregate leaderboard in response to determining that the first leaderboard and the second leaderboard are sponsored by a same sponsor.

18. The non-transitory, machine-readable storage medium of claim 15, wherein the operations for ranking the first player and the second player based, at least in part, on the aggregate of the first data and the second data includes operations comprising:

determining a first score from the first plurality of scores based on a position of the first player on a first leaderboard of the plurality of leaderboards associated with the first type of game;

determining a second score from the first plurality of scores based on a position of the first player on a second leaderboard of the plurality of leaderboards associated with the second type of game;

determining a third score from the second plurality of scores based on a position of the second player on the first leaderboard;

determining a fourth score from the second plurality of scores based on a position of the second player on the second leaderboard;

computing a first rank for the first player based on an aggregate of the first score and the second score;

computing a second rank for the second player based on an aggregate of the third score and the fourth score; and ranking the first player and the second player based on the first rank and the second rank.

19. The non-transitory, machine-readable storage medium of claim 15, wherein the operations for aggregating the first data and the second data includes operations comprising:

determining a first type of metric for the first data;

determining a second type of metric for the second data;

converting the second type of metric to the first type of metric; and wherein the ranking the first player and the second player based, at least in part, on the aggregate of the first data and the second data comprises using the first type of metric to rank the first player and the second player on the aggregate leaderboard.

20. The non-transitory, machine-readable storage medium of claim 15, said operations further comprising prolonging a wagering game event at a wagering game machine associated with the first player in response to determining that a rank of the first player on the aggregate leaderboard meets a threshold rank value.

* * * * *